US009168580B2

(12) United States Patent
Cao et al.

(10) Patent No.: US 9,168,580 B2
(45) Date of Patent: Oct. 27, 2015

(54) SYSTEM AND METHOD FOR ACCUMULATIVE DOUBLE SIDED INCREMENTAL FORMING

(71) Applicant: Northwestern University, Evanston, IL (US)

(72) Inventors: Jian Cao, Wilmette, IL (US); Rajiv Malhotra, Evanston, IL (US)

(73) Assignee: Northwestern University, Evanston, IL (US)

( * ) Notice: Subject to any disclaimer, the term of this patent is extended or adjusted under 35 U.S.C. 154(b) by 442 days.

(21) Appl. No.: 13/654,071

(22) Filed: Oct. 17, 2012

(65) Prior Publication Data

US 2013/0103177 A1 Apr. 25, 2013

Related U.S. Application Data

(60) Provisional application No. 61/550,666, filed on Oct. 24, 2011, provisional application No. 61/612,034, filed on Mar. 16, 2012, provisional application No. 61/642,598, filed on May 4, 2012.

(51) Int. Cl.
*G06F 19/00* (2011.01)
*B21D 31/00* (2006.01)

(52) U.S. Cl.
CPC ..... *B21D 31/005* (2013.01)

(58) Field of Classification Search
USPC ..... 700/98; 72/429, 379.2
See application file for complete search history.

(56) References Cited

U.S. PATENT DOCUMENTS

| | | | |
|---|---|---|---|
| 4,273,738 | A | 6/1981 | Spengler |
| 4,532,793 | A | 8/1985 | Bezold |
| 6,798,088 | B2 | 9/2004 | Hsu et al. |
| 6,826,172 | B1 | 11/2004 | Augart |
| 7,172,375 | B2 | 2/2007 | Tanoue et al. |
| 7,357,769 | B2 | 4/2008 | Takayama et al. |
| 7,416,473 | B2 | 8/2008 | Belli et al. |
| 7,516,640 | B2 | 4/2009 | Golovashchenko et al. |
| 8,021,501 | B2 | 9/2011 | Roth |

(Continued)

FOREIGN PATENT DOCUMENTS

| | | |
|---|---|---|
| WO | WO 2007082972 | 7/2007 |
| WO | WO 2012030835 | 8/2012 |

OTHER PUBLICATIONS

Skjoedt et al., Creating Hekical Tool Paths for Single Point Incremental Forming, 2007, University of Denmark, p. 253-590.*

(Continued)

*Primary Examiner* — Kidest Bahta
(74) *Attorney, Agent, or Firm* — Cook Alex Ltd.

(57) ABSTRACT

A forming system includes first and second tools, moving assemblies, and a control unit. The moving assemblies move the first tool and the second tool relative to the sheet. The control unit is configured to control movement of the first tool and the second tool by the one or more moving assemblies by moving at least one of the first tool or the second tool in a first deformation direction to deform the sheet, then moving the first and second tools laterally relative to the sheet to a subsequent location while engaging the sheet, then moving at least one of the first tool or the second tool in the first deformation direction or an opposite second deformation direction to deform the sheet, and then continue moving the first and second tools to deform the sheet in order to create a three-dimensional component from the sheet.

25 Claims, 27 Drawing Sheets

(56) References Cited

U.S. PATENT DOCUMENTS

| | | | | |
|---|---|---|---|---|
| 8,302,442 | B2 * | 11/2012 | Kiridena et al. | 72/115 |
| 8,322,176 | B2 | 12/2012 | Johnson et al. | |
| 8,741,079 | B2 | 6/2014 | Roth et al. | |
| 2002/0169857 | A1 | 11/2002 | Martija et al. | |
| 2003/0046022 | A1 | 3/2003 | Silverman | |
| 2009/0044590 | A1 | 2/2009 | Roth | |
| 2009/0158805 | A1 | 6/2009 | Callebaut et al. | |
| 2009/0226272 | A1 * | 9/2009 | Smith et al. | 409/80 |
| 2010/0107720 | A1 | 5/2010 | Polen et al. | |
| 2010/0199742 | A1 | 8/2010 | Johnson et al. | |
| 2012/0024034 | A1 | 2/2012 | Ren et al. | |
| 2012/0024035 | A1 | 2/2012 | Kiridena et al. | |

OTHER PUBLICATIONS

Merie et al., Two Point Incremental Forming with two Moving Forming tools , 2007, LPS, p. 599-605.*

Callegari et al., Sheet Incremental Forming: Advantages of Robotised Cells vs. CNC Machines, 2006, Industrial RoboticPragramming , Simulation and Applicantion, Book, p. 494-515.*

International Search Report and Written Opinion for PCT/US12/60616 dated Apr. 5, 2013.

Incremental Forming of Sheet Metal (27097), J. Cao, V. Reddy and Y. Wang, http://ttp.northwestern.edu/abstracts/viewabs.php?id=344&cat=157.

Chinese Journal of Mechanical Engineering, vol. 43, No. 12, Dec. 2007, Incremental Forming Methods on Complicated Sheet Parts with English Translation of Abstract.

International Preliminary Report on Patentability from PCT/US2012/060616 issued Apr. 29, 2014.

Allwood, J.M., Braun, D., Music, O., The effect of partially cut-out blanks on geometric accuracy in incremental sheet forming, Journal of Materials Processing Technology, Journal of Materials Processing Technology 210 (2010), pp. 1501-1510.

Allwood, J.M., Music, O., Raithathna, A., Duncan, S., Closed-loop feedback control of product properties in flexible metal forming processes with mobile tools, CIRP Annal—Manufacturing Technology 58 (2009), pp. 287-290.

Formisano, A., Durante, M., Langella, A., Minutolo, F. Capece, Manufacture of a component with concave-convex shape by backdrawing incremental forming process, Department of Materials and Production Engineering (5 pgs).

Jeswiet, J., Micari, F., Hirt, G., Brameley, A., Duflou, J., Allwood, J., Asymmetric Single Point Incremental Forming of Sheet Metal, *CIRP Annals—Manufacturing Technology*, (2005) vol. 54(2), pp. 88-114.

Li, M, Zhang, L., Mo, Jr., Liu, G., Tool-path generation method for sheet metal incremental forming process, Materials Research Innovations, vol. 15, Suppl. 1, (2011) , pp. s278-s282.

M. Skjoedt, M.H. Hancock, N. Bay, Creating Helical Tool Paths for Single Point Incremental Forming, Key Engineering Materials v. 344 (2007), pp. 583-590.

Malhotra, R., Cao, J., Beltran, M., Xu, D., Magargee, J., Kiridena, V., Xia, Z. C., Accumulative-DSIF Strategy for Enhancing Process Capabilities in Incremental Forming, *CIRP Annals—Manufacturing Technology*, vol. 61 (2012), pp. 251-254.

Malhotra, R., Cao, J., Ren, F., Kiridena, V., Xia, C., Reddy, N., Improvement of Geometric Accuracy in Incremental Forming by Using a Squeezing Toolpath Strategy With Two Forming Tools, Journal of Manufacturing Science and Engineering, (Dec. 2011), vol. 133, pp. 061019/1-061019/10.

Malhotra, R., Reddy, N.V., Cao, J., Automatic 3D Spiral Toolpath Generation for Single Point Incremental Forming, *Journal of Manufacturing Science and Engineering*, (Dec. 2010), vol. 132, pp. 061003/1-061003/10.

Meier, H., Magnus, C., Smukala, V., Impact of superimposed pressure on dieless incremental sheet metal forming with two moving tools, CIRP Annals—Manufacturing Technology 60 (2011) pp. 327-330.

Meier, H., Smukala, V., Dewald, O., Zhang, J., Two Point Incremental Forming with Two Moving Forming Tools, Key Engineering Materials, vol. 344 (2007), pp. 599-605.

Paniti, Imre, CAD API Based Tool Path Control for Novel Incremental Sheet Forming, Pollack Periodica, vol. 5, No. 2 (2010) pp. 81-90.

Tekkaya, A. Erman, Shankar, Ravi , Sebastiani, Gerd, Homberg, Werner and Kleiner, Matthias, Surface reconstruction for incremental forming, Springer, (2007) Prod. Eng. Res. Devel. 1, pp. 71-78.

ISR and W/O for PCT/US2011/034360 dated Nov. 13, 2012.

ISR and WO for PCT/US12/60616 dated Apr. 5, 2013.

* cited by examiner

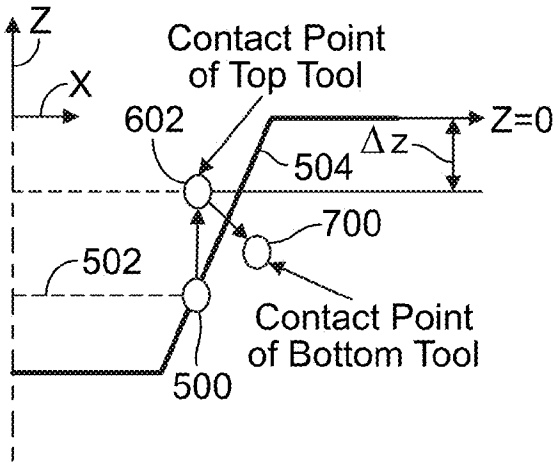
FIG. 5
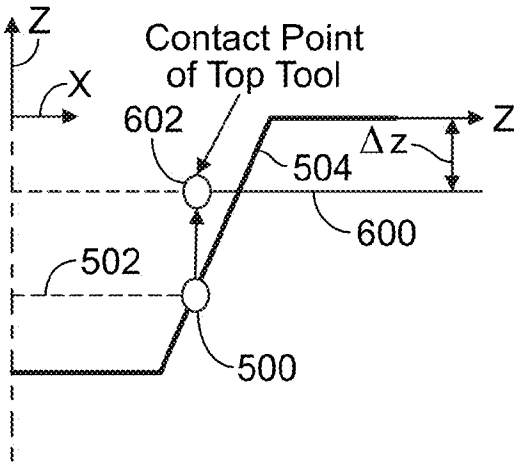
FIG. 6
FIG. 7

SYSTEM AND METHOD FOR ACCUMULATIVE DOUBLE SIDED INCREMENTAL FORMING

CROSS-REFERENCE TO RELATED APPLICATIONS

This application claims priority to U.S. Provisional Application No. 61/550,666, which was filed on 24 Oct. 2011, and is entitled "System And Method For Incremental Forming" (the "'666 application"), U.S. Provisional Application No. 61/612,034, which was filed on 16 Mar. 2012, and is entitled "System And Method For Accumulative Double Sided Incremental Forming" (the "'034 application"), and U.S. Provisional Application No. 61/642,598, which was filed on 4 May 2012, and is entitled "System And Method For Accumulative Double Sided Incremental Forming" (the "'598 application"). The entire disclosures of the '666 application, the '034 application, and the '598 application are incorporated by reference.

STATEMENT REGARDING FEDERALLY SPONSORED RESEARCH & DEVELOPMENT

This invention was made with Government support under CMMI0727843 awarded by the National Science Foundation, and DE-EE0003460 awarded by the Department of Energy. The Government has certain rights in the invention.

BACKGROUND

Incremental Forming (IF) is a flexible sheet metal forming technique that uses tooling to locally deform sheet metal along a predefined toolpath to impart the sheet with a desired or designated shape, such as a three-dimensional shape. Single Point Incremental Forming (SPIF) uses one tool on one side of the sheet to cause the deformation. One drawback with SPIF is an inherent geometric inaccuracy of creating the designated shape due to unintended non-local deformation and subsequent springback of the sheet in the single point setup.

One potential solution to the unintended non-local deformation in SPIF is to use partially cut out blanks along a periphery of a forming area in the sheet. While the obtained geometric accuracy of the sheet may be improved over SPIF described above, this technique of using the partially cut out blanks may not useful in improving geometric accuracy in IF relative to the significantly better geometric accuracy provided by use of a partial support of the sheet, in spite of the resultant loss in process flexibility associated with using such a support. A closed-loop feedback control has been used in some known SPIF processes to improve the geometric accuracy in SPIF by forming the component in a second iteration. Although the result obtained from the second iteration was better than the initial iteration, such a process may be time consuming and difficult to be implemented for freeform objects, such as asymmetrical objects, objects whose shape is not defined by a single mathematical relationship (e.g., equation or function between two or more geometric axes), amorphous objects, and the like.

Other variations of IF include die-based IF (DBIF), which uses a die below the sheet, and double-sided IF (DSIF), which uses one tool above the sheet and another tool below the sheet. One drawback to DBIF is that the process can be limited to forming components on one side of the sheet only and can require process planning that is specific to the part geometry being formed. For example, the die that lies below the sheet may need to be separately formed in advance of the forming of the sheet. This additional processing step and equipment adds to the cost and complexity of the forming of the sheet.

In DSIF, two tools can be located on either side of a sheet, with each tool mounted on a robot that controls movement of the tool. The tools may be moved toward each other to squeeze the sheet between the tools and to form desired shapes. For example, the gap between tools may be smaller than the thickness of the sheet to form a "squeezing toolpath" of the tools. This technique, however, may require an accurate thickness prediction of the sheet because, if the thickness prediction is inaccurate, one or more of the tools may lose contact with the sheet and DSIF will degenerate to SPIF. To maintain contacts of both tools with the sheet, a forming tool that is displacement controlled (e.g., the tool is controlled to move designated distances independent of the force imparted by the tool on the sheet) and a supporting tool that uses both displacement control (as previously described) and force control (e.g., the tool is controlled to exert a designated force on the sheet, independent of the distance that the tool is displaced to impart the force) may be used. While this technique could provide contact between the supporting tool and the sheet, the amount of force to be applied to the sheet and a preset angular offset for the supporting tool may need to be determined through time-consuming, repetitive trials or experiments each time the shape of the completed component (to which the sheet is formed) changes. Furthermore, depending on the global shape of the component, the force required to form the shape may change.

In the known DSIF techniques described above, conventional "out-to-in" toolpaths were used for the forming tool. In such a toolpath, the forming begins with the tool disposed at or near the outermost periphery of the sheet or component to be formed (e.g., where the component is formed from less than all of the sheet, a location at or near the outer edge of the final, completed component) and travels all the way down to the actual component depth, while moving in the X-Y plane of the sheet. For example, the tool may move from the outer edge of the component toward the center of the component. Such a toolpath may require the controls (e.g., displacement control for the top tool and both displacement and force control for the bottom tool) described above.

BRIEF DESCRIPTION

In one embodiment, a system (e.g., a forming system) includes first and second tools, one or more moving assemblies, and a control unit. The first tool is configured to be disposed on a first side of a deformable sheet and the second tool is configured to be disposed on an opposite, second side of the sheet. The moving assemblies are configured to move the first tool and the second tool relative to the sheet. The control unit is configured to control movement of the first tool and the second tool by the one or more moving assemblies by moving at least one of the first tool or the second tool in a first deformation direction to deform the sheet, then moving the first and second tools laterally relative to the sheet to a subsequent location while engaging the sheet, then moving at least one of the first tool or the second tool in the first deformation direction or an opposite second deformation direction to deform the sheet, and then continue moving the first and second tools to deform the sheet in order to create a three-dimensional component from the sheet.

In one embodiment, a method (e.g., for forming a deformable sheet) includes engaging a first tool with a first side of the deformable sheet and a second tool with an opposite, second side of the sheet, moving at least one of the first tool or the second tool in a first deformation direction to deform the sheet, laterally moving the first and second tools relative to the sheet to a subsequent location while engaging the sheet, moving at least one of the first tool or the second tool in the first deformation direction or an opposite second deformation direction to deform the sheet, and continuing to move the first and second tools in at least one of the first deformation direction, the second deformation direction, or laterally relative to the sheet in order to create a three-dimensional component from the sheet.

In one embodiment, a system (e.g., a control system or control unit for a forming system) includes an input module, an equalization module, a sorting module, a point generation module, and a path writing module. The input module is configured to obtain a three-dimensional model of a component to be formed from a deformable sheet by first and second tools that engage corresponding first and second opposite sides of the sheet and that move relative to the sheet to deform the sheet. The three-dimensional model includes plural three-dimensional features that protrude from at least one of the first side or second side of the sheet. The equalization module is configured to an incremental depth at which the at least one of the first and second tools move toward or away from the sheet to form the features in the sheet. The incremental depth is based on a number of curves formed by intersections of the model with a set of planes oriented parallel to the sheet. The sorting module is configured to associate at least a first set of the curves formed by the intersections of the model with the planes with a first feature of the features in the model and a second set of the curves formed by the intersections of the model with the planes with a different, second feature of the features in the model. The point generation module is configured to determine one or more toolpaths that the first and second tools follow in order to deform the sheet into the component. The point generation module also is configured to determine segments of the model that are disposed between neighboring planes in the set of planes and to determine one or more helical curves extending along the segments from an internal area of the sheet toward outer boundaries of the sheet. The path writing module is configured to identify contact points along the one or more toolpaths and directions in which the first and second tools are to move along the one or more toolpaths. The contact points are locations where the first and second tools are to engage and deform the sheet to form the component from the sheet based on the model. The path writing module determines the contact points and the directions such that the first and second tools move along the one or more toolpaths in an in-to-out direction laterally along the sheet.

In one embodiment, a system (e.g., a forming system) includes first and second tools, one or more moving assemblies, and a control unit. The first tool is configured to be disposed on one side of a deformable sheet. The second tool is configured to be disposed on an opposite side of the sheet. The moving assemblies are configured to move the first tool and the second tool relative to the sheet. The control unit is configured to control movement of the first tool and the second tool by the one or more moving assemblies. The control unit is configured to move the first and second tools in a deformation direction to deform the sheet, then move the first and second tools laterally to a subsequent location while engaging the sheet, then move the first and second tools in the deformation direction or an opposite direction to deform the sheet, and to continue moving the first and second tools to deform the sheet in order to create a three-dimensional component from the sheet.

In another embodiment, a method (e.g., a forming method) includes engaging a first tool with one side of a deformable sheet, engaging a second tool with an opposite side of the sheet, moving the first and second tools in a deformation direction to deform the sheet, laterally moving the first and second tools to a subsequent location while engaging the sheet, deforming the sheet by moving the first and second tools in the deformation direction or an opposite direction, and moving the first and second tools to deform the sheet in order to create a three-dimensional component from the sheet.

In another embodiment, another system (e.g., a forming system) includes a first tool, a second tool, one or more moving assemblies, and a control unit. The first tool is configured to be disposed on one side of a deformable sheet. The second tool is configured to be disposed on an opposite side of the sheet. The one or more moving assemblies are configured to move at least one of the first tool and the second tool relative to the sheet. The control unit is configured to control movement of the first tool and the second tool by the one or more moving assemblies. The control unit is configured to move the at least one of the first and second tools in a deformation direction to deform the sheet, then move the at least one of the first and second tools laterally to a subsequent location while engaging the sheet, then move the at least one of the first and second tools in the deformation direction or an opposite direction to deform the sheet, and to continue moving the at least one of the first and second tools to deform the sheet in order to create a three-dimensional component from the sheet.

In another embodiment, another system (e.g., a forming system) includes a first tool, a second tool, one or more moving assemblies, and a control unit. The first tool is configured to be disposed on one side of a deformable sheet. The second tool is configured to be disposed on an opposite side of the sheet. The one or more moving assemblies are configured to move the first tool and the second tool relative to the sheet. The control unit is configured to control movement of the first tool and the second tool by the one or more moving assemblies. The control unit is configured to move the first and second tools in a deformation direction to deform the sheet (where a point of contact corresponding to a beginning edge of a bend in the sheet does not lie along a line connecting centers of hemispheres corresponding to the first and second tools), then move the first and second tools laterally to a subsequent location while engaging the sheet, then move the first and second tools in the deformation direction or an opposite direction to deform the sheet, and to continue moving the first and second tools to deform the sheet in order to create a three-dimensional component from the sheet.

At least one technical effect disclosed herein is the formation of a variety of three-dimensional components from a planar sheet of deformable material without having to remove the sheet from a system that forms the components and/or without deforming previously formed features during the forming of other features of the components.

BRIEF DESCRIPTION OF THE DRAWINGS

The present inventive subject matter will be better understood from reading the following description of non-limiting embodiments, with reference to the attached drawings. Although reference is made the drawings representing embodiments, other embodiments, another embodiment, different embodiments, and the like, the embodiments shown in the drawings are not mutually exclusive. Two or more of the embodiments shown in different drawings may be combined together in a single embodiment of the inventive subject matter.

FIG. 5 illustrates steps or operations for generating a toolpath for an ADSIF process in accordance with one embodiment.

FIG. 6 illustrates additional steps or operations for generating the toolpath for the ADSIF process in accordance with one embodiment.

FIG. 7 illustrates additional steps or operations for generating the toolpath for the ADSIF process in accordance with one embodiment.

DETAILED DESCRIPTION

As used herein, an element or step recited in the singular and proceeded with the word "a" or "an" should be understood as not excluding plural of said elements or steps, unless such exclusion is explicitly stated. Furthermore, references to "one embodiment" of the presently described subject matter are not intended to be interpreted as excluding the existence of additional embodiments that also incorporate the recited features. Moreover, unless explicitly stated to the contrary, embodiments "comprising," "comprises," "including," "includes," "having," or "has" an element or a plurality of elements having a particular property may include additional such elements not having that property. Additionally, values of variables, coefficients, and the like are not intended to be limiting on all embodiments of the presently described inventive subject matter. In at least one embodiment, one or more different values may be used. The term "optimize" (and derivations thereof) is used herein, but does not require that a value or variable associated with the term "optimize" be maximized, minimized, or eliminated in all embodiments. For example, an "optimized" value may be a value that is increased or decreased (as appropriate) toward a designated goal value or other value, but that may not actually be the maximum or minimum value.

Figure 1:
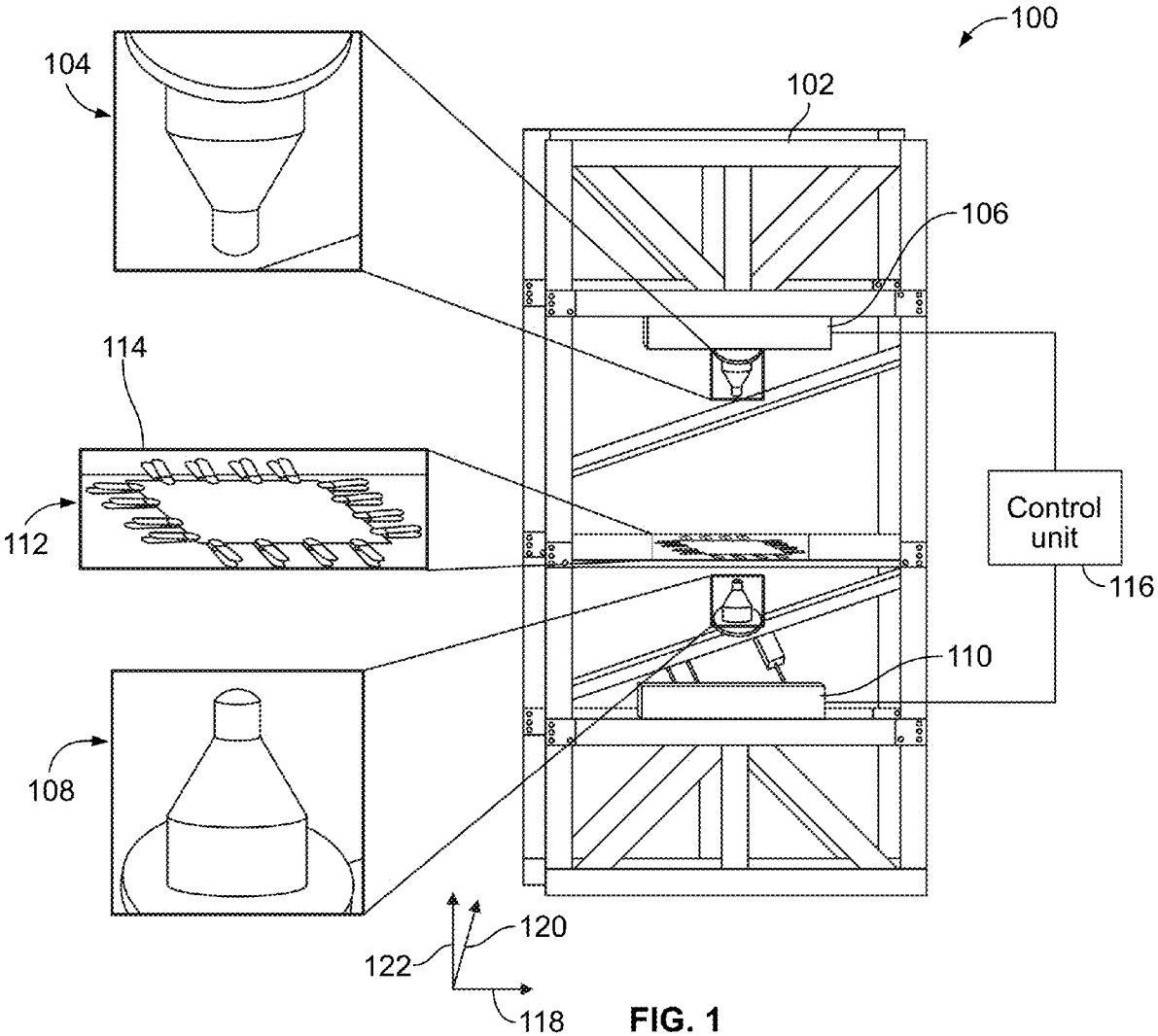
FIG. 1 is a plan view of one embodiment of an accumulative double sided incremental forming (ADSIF) system.

FIG. 1 is a plan view of one embodiment of an accumulative double sided incremental forming (ADSIF) system 100. The system 100 may be used in connection with one or more forming techniques described herein to form three-dimensional shapes from a planar malleable body, such as a sheet of metal or metal alloy. While the discussion herein focuses on forming components (e.g., three-dimensional shapes) from a metal sheet, other materials may be used to form the components. References to a sheet or a metal sheet should not be intended to exclude malleable sheets formed from one or more different or additional materials. The system 100 includes a frame 102 that supports various components of the system 100. A top or upper tool 104 may be coupled with the frame 102 by one or more moving assemblies 106 (e.g., gantries, such as a robot, rack and slide assembly, moveable chain, or other device) that can move the top tool 104 along one or more of orthogonal X, Y, and/or Z directions 118, 120, 122. As shown in FIG. 1, the X and Y directions or axes 118, 120 are located in the plane of the sheet that is deformed by the system 100 and the Z direction or axis is oriented perpendicular to the plane of the sheet that is deformed. The top upper 104 may be a stationary tool. For example, the upper tool 104 may be moved by the other moveable parts of the system 100, but may not itself move, such as by rotating or spinning.

A bottom or lower tool 108 may be coupled with the frame 102 by one or more moving assemblies 110. The moving assemblies 110 can move the lower tool 108 along one or more of the X, Y, and/or Z directions 118, 120, 122. The lower tool 108 may move independent of the upper tool 104. For example, the directions and/or distances in which the lower tool 108 moves may be unrelated to the directions and/or distances in which the upper tool 104 moves. The bottom tool 108 may be a stationary tool. For example, the bottom tool 108 may be moved by the other moveable parts of the system 100, but may not itself move, such as by rotating or spinning.

The terms "upper" and "lower" are used to identify the tools 104, 108, but not to require any particular location of the tools 104, 108 other than the tools 104, 108 being on opposite sides of the sheet being formed. For example, the "upper" tool 104 may be on one side of the sheet while the "bottom" tool 108 is on the opposite side of the sheet. But, the "upper" tool 104 need not be above the sheet and the "lower" tool 108 need not be below the sheet with respect to the surface of the earth or the direction of gravity.

The upper tool 104 may be referred to as a forming tool and the lower tool 108 may be referred to as a supporting tool and/or squeezing tool. Alternatively, the lower tool 108 may be the forming tool and the upper tool 104 may be the supporting tool. In one embodiment, during the forming of the same component from the sheet, the tools 104, 108 may switch between being the forming tool and the supporting/squeezing tool. For example, during the formation of a first part of a component, the upper tool 104 may be the forming tool while the lower tool 108 is the supporting/squeezing tool. During the formation of a second part of the same component, the upper tool 104 may switch to being the supporting/squeezing tool and the lower tool 108 may switch to being the forming tool without removing the sheet from between the tools 104, 108 and/or without switching the positions of the tools 104, 108 (e.g., without moving the tool 104 from a first side of the sheet to a second, opposite side of the sheet and without moving the tool 108 from the second side of the sheet to the first side of the sheet).

A clamping assembly 112 holds the sheet that is to be formed into a component by the system 100. The clamping assembly 112 may include one or more clamps 114 that secure the sheet so that the sheet remains stationary while the tools 104 and/or 108 move relative to the sheet.

A control unit 116 is schematically shown in FIG. 1. The control unit 116 is communicatively coupled (e.g., by one or more wired and/or wireless connections) with the moving assemblies 106, 110. The control unit 116 includes one or more processing units and/or modules that operate to control movements of the upper tool 104 and/or lower tool 108 relative to the sheet. As used herein, the terms "unit" or "module" include a hardware and/or software system that operates to perform one or more functions. For example, one or more units or modules may include or be embodied in one or more computer processors, controllers, and/or other logic-based devices that perform operations based on instructions stored on a tangible and non-transitory computer readable storage medium, such as a computer memory. Alternatively, a unit or module may include a hard-wired device that performs operations based on hard-wired logic of a processor, controller, or other device. In one or more embodiments, a unit or module includes or is associated with a tangible and non-transitory (e.g., not an electric signal) computer readable medium, such as a computer memory. The units or modules shown in the attached figures may represent the hardware that operates based on software or hardwired instructions, the computer readable medium used to store and/or provide the instructions, the software that directs hardware to perform the operations, or a combination thereof. The control unit 116 shown in FIG. 1 may include or represent one or more input devices (e.g., keyboard, touchscreen, disk drive, microphone, and the like) to receive instructions from a human operator to direct how the tools 104, 108 are moved to form components from the sheet. The control unit 116 may include one or more modules that perform the operations described herein. These modules are described below.

In one embodiment, movement of each tool 104, 108 along the X and Y axes 118, 120 is controlled using two motors on a double gantry system (e.g., the moving assemblies 106, 110). Alternatively, a different number of motors may be used, such as a single motor or three or more motors. Movement of the tools 104, 108 along the Z axis 122 can be controlled by a single linear guide and motor (e.g., as part of the moving assemblies 106, 110). Alternatively, a different component may control these movements and/or a greater number of guides and motors can control the movement. The tools 104, 108 are controlled by the control unit 116 which, by way of non-limiting example only, may be a DELTA-TAU controller. The velocity of the lower tool 108 can be automatically adjusted by the control unit 116 to compensate for corresponding toolpath points for the lower tool 108 potentially being farther apart or closer together than the corresponding points for the upper tool 104, thereby maintaining fully synchronized motion of the tools 104, 108. The forming area (e.g., the area of the clamping assembly 112 in which the sheet may be formed) is approximately 250 mm by 250 mm in one embodiment. Alternatively, the forming area may be smaller or larger in one or more dimensions. Each tool 104, 108 can be mounted on a six-degree-of-freedom load cell to record forming forces and moments. A lubricant can be used at the tool-sheet interface, such as a petroleum jelly base with graphite particles suspended in the base.

In one embodiment, the tools 104, 108 are controlled according to an Accumulative Double Sided Incremental Forming (ADSIF) technique, process, or strategy for DSIF where both tools 104, 108 are displacement controlled. For example, the tools 104, 108 may be controlled to move to designated positions or distances from a previous or designated location, rather than the tools 104, 108 being controlled so as to impart a designated force on the sheet.

Contact between both tools 104, 108 and the sheet is maintained at all times during the forming process in one embodiment. For example, each of the upper tool 104 and the lower tool 108 may abut, engage, or otherwise physically and directly contact the sheet while the tools 104, 108 are used to form a component from the metal sheet. The tools 104, 108 may be used to create a freeform geometry of a component since the toolpath of the tool 104 and/or the tool 108 can be decided a-priori based on designated geometry of the desired component, such as computer aided drafting (CAD) geometry. In one embodiment, the toolpath strategy for ADSIF (e.g., the process for controlling the tools 104, 108) may be used to form three-dimensional components from a single metal sheet with protruding features from both sides of the sheet, as well components with concavo-convex features, without flipping the sheet or changing the tooling in the forming process. Examples of some components that may be formed in accordance with one or more embodiments described herein are shown and described below. One or more embodiments of the ADSIF process described herein prevent loss of contact between both tools 104, 108 and the sheet without using any shape specific adaptive strategies, while using a relatively simple sine law to position the lower tool 108.

Figures 2, 3:
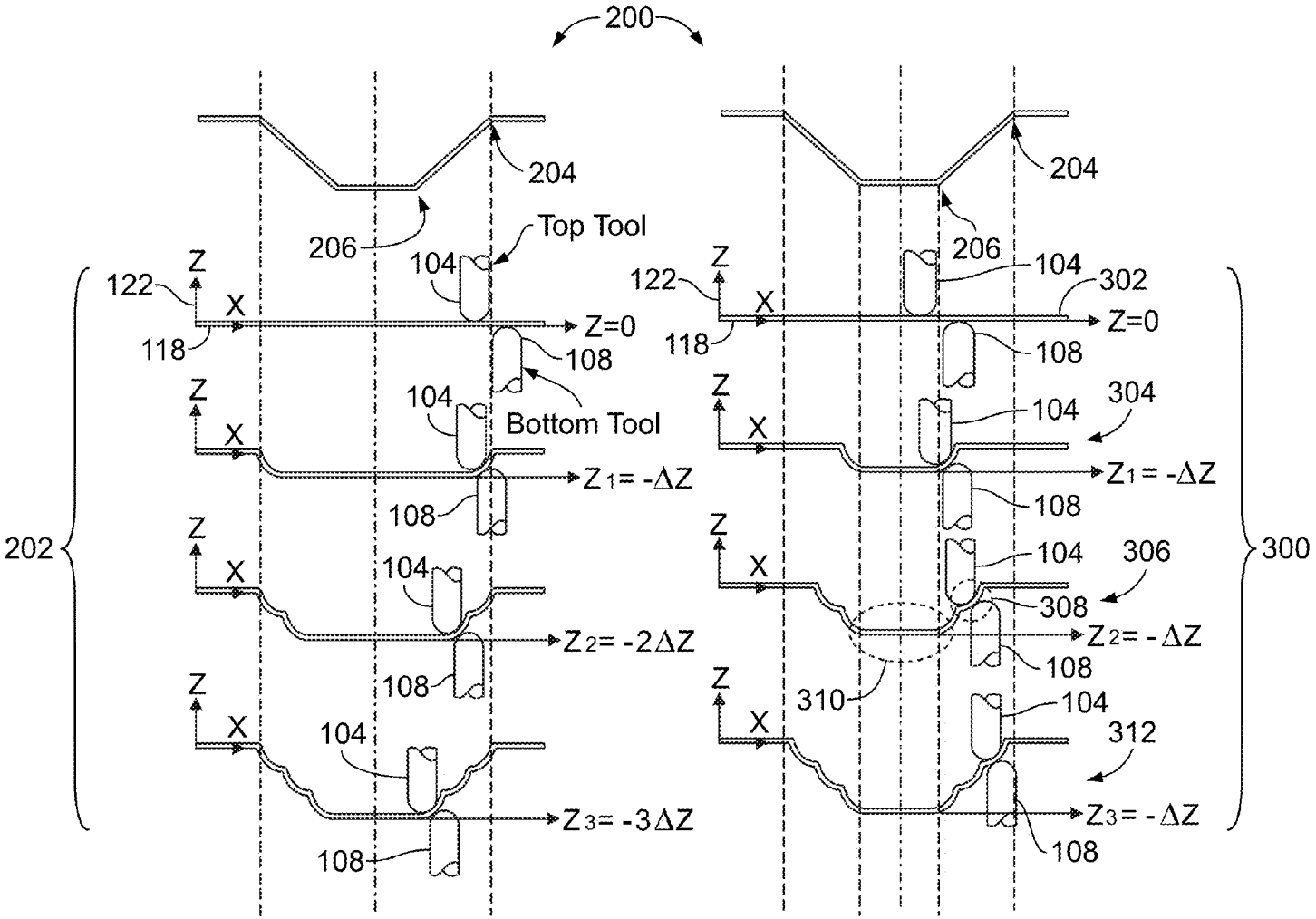
FIG. 2 illustrates formation of a cone-shaped component according to one example of an out-to-in DSIF toolpath process.
FIG. 3 illustrates formation of the same cone-shaped component according to an in-to-out ADSIF toolpath process provided in accordance with one embodiment of the inventive subject matter.

FIG. 2 illustrates formation of a cone-shaped component 200 according to one example of an out-to-in DSIF toolpath process 202. FIG. 3 illustrates formation of the same cone-shaped component 200 according to an in-to-out ADSIF toolpath process 300 provided in accordance with one embodiment of the inventive subject matter. The forming of the cone 200 is performed with the upper tool 104 as the forming tool and the lower tool 108 as the supporting tool.

In the out-to-in DSIF toolpath process 202, forming begins at the largest diameter 204 (e.g., the outer edge) of the cone 200 and ends at the smallest diameter 206, while the tools 104, 108 travel simultaneously in the X, Y and Z directions 118, 120, 122 (the Y direction 120 extends perpendicular to the viewing plane of FIGS. 2 and 3). The process 202 is shown in FIG. 2 as proceeding downward with earlier steps or operations disposed above later steps or operations. If a constant incremental forming depth ($\Delta z$) is used (e.g., each step of adding depth to the cone 200 along the Z direction 122), by the 3rd pass, both tools 104, 108 will be at Z positions of $-3\Delta z$ relative to the starting Z positions of the tools 104, 108. For example, the tools 104, 108 each move the same forming depth ($\Delta z$) in the same direction for each step of movement or pass.

When using the in-to-out ADSIF toolpath process 300 to form the same cone 200, the forming process 300 proceeds in an opposite direction. For example, the process 300 may begin from the smallest diameter 206 of the cone 200 and end at the largest diameter 204 of the cone 200. At a first pass 304, the forming and supporting tools 104, 108 form the sheet 302 to a depth equal to the specified incremental depth $\Delta z$. Movements in the Z direction 122 may be referred to as movements in the depth direction. Then, in the second pass 306, both the forming tool 104 and the supporting tool 108 move outward (e.g., laterally or in a lateral direction) in the XY plane (e.g., the plane of the sheet 302) but maintain the same Z position (e.g., maintain the same vertical or depth positions). Consequently, the second pass 306 deforms the next outlying region 308 of the sheet 302 by a distance $\Delta z$. Meanwhile, due to the rigid body movement, the region 310 of the sheet 302 formed in the first pass 304 is displaced down in the negative Z direction (in the view shown in FIG. 3) by an amount equal to $\Delta z$. Hence, the Z position of the component 200 after the second pass 306 is $-2\Delta z$.

When a third pass 312 is formed (and the tools 104, 108 are laterally moved outward from previous positions), the component base 200 is at a Z position of $-3\Delta z$ while both tools 104, 108 remain at the same Z position of $-\Delta z$. The shape of the component 200 in the X-Y plane is controlled by the motion of the forming and supporting tools 104, 108 as generated from the CAD model (or another model) and as controlled by the control unit 116 (shown in FIG. 1).

Figure 4:
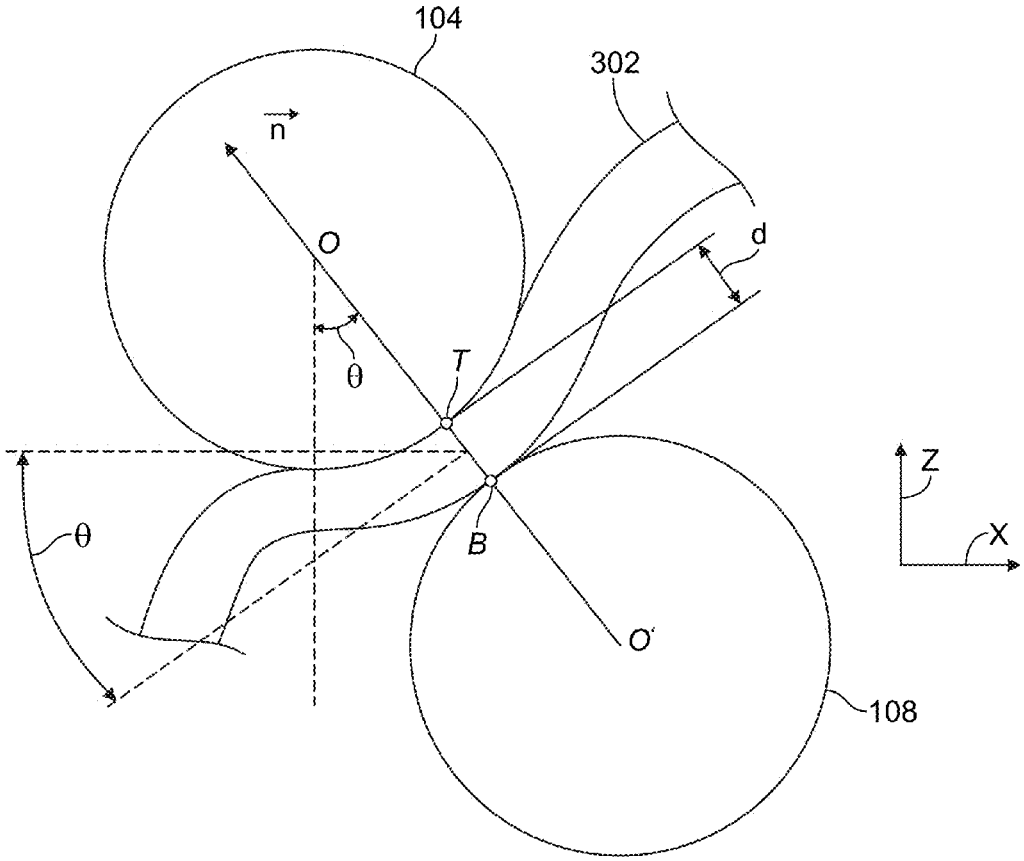
FIG. 4 is a schematic view of positioning tools shown in FIG. 1 on opposite sides of a sheet in accordance with one embodiment.

FIG. 4 is a schematic view of positioning the tools 104, 108 on opposite sides of a sheet 302 in accordance with one embodiment. The local angle generated at each deformation point (e.g., each location where the sheet 302 is contacted and deformed by the tool 104 and/or 108) may be controlled by the position of the supporting tool (e.g., the tool 108) in relation to the forming tool (e.g., the tool 104). As shown in FIG. 4, a local wall angle $\theta$ is equal or approximately equal to an angle subtended to a vertical by a line segment OO' that connects centers of the two hemispherical tools 104, 108. The position of the supporting tool 108 may be is calculated according to:

$$O'=O-(R_1+R_2+d)n \quad \text{(Eqn. 1)}$$

where O' represents a vector coordinate of the supporting tool center O', O represents a vector coordinate of the forming tool center O, $R_1$ and $R_2$ represent the radii of the forming and supporting tools 104, 108, respectively, and n represents a unit normal at a local contact point T.

The distance d in Equation 1 between the closest surfaces of the tools 104, 108 is based on the sine law:

$$d=(t_0 \cos \theta)s \quad \text{(Eqn. 2)}$$

The variable $t_0$ represents the thickness of the sheet 302 prior to deformation by the tools 104, 108. The distance d may represent (or approximate) the desired thickness of the deformed wall or sheet 302, such as a designated thickness of the sheet 302 after being deformed by the tools 104, 108. The constant s (which may have a variable or operator designated value of ≤1.0) determines the amount of squeezing that the sheet 302 experiences by the tools 104, 108. For larger values of s, the sheet 302 may be squeezed by a lesser amount, and for smaller values of s, the sheet 302 may be squeezed by larger amounts. The components shown herein were formed with s=1.0, except when explicitly stated otherwise.

FIGS. 5 through 7 illustrate sequential steps or operations for generating a toolpath for an ADSIF process in accordance with one embodiment. In FIG. 5, contact points 500 and a corresponding normal 502 are generated on a contour 504 to be formed in the sheet 302 (shown in FIG. 3) at a designated Z depth, $Z=Z_1$. In FIG. 6, the contact point 500 is projected onto a plane 600 located at Z=−Δz plane (FIG. 4*b*) to obtain a contact point 602 of the upper tool 104. The contact point 602 may represent the point T shown in FIG. 4. The contact point 500 of the lower tool 108 (e.g., the point B shown in FIG. 4) may be calculated based on Equations 1 and 2. Subsequently, in FIG. 7, tool tip points 602, 700 for the forming tool 104 and supporting tool 108, respectively, may be generated according to Equations 3 and 4:

$$TT_{top}=\vec{T}+(R_1\vec{n})-(R_1\vec{z}) \quad \text{(Eqn. 3)}$$

$$TT_{bottom}\vec{B}-(R_2\vec{n})+(R_2\vec{z}) \quad \text{(Eqn. 4)}$$

where $TT_{top}$ represents the tool tip point 602 for the upper tool 104 and $TT_{bottom}$ represents the lower tool tip point 700 for the lower tool 108. Instead of controlling the X, Y, and Z locations of deformation as in a known DSIF/SPIF toolpath, the toolpath in ADSIF may control the local formed angle in the X-Y plane and the shape formed in the X-Y plane. The local formed angle automatically imparts the desired depth to the component formed by deformation of the sheet.

In accordance with another embodiment, a toolpath is first generated in DSIF in order to create a contour on the surface of the component at a constant Z depth (e.g., the tools 104, 108 return to the same Z location). Once this is done, the contact points of the tools 104, 108 on the sheet can be used to position the two tools 104, 108 relative to each other.

Figure 8:
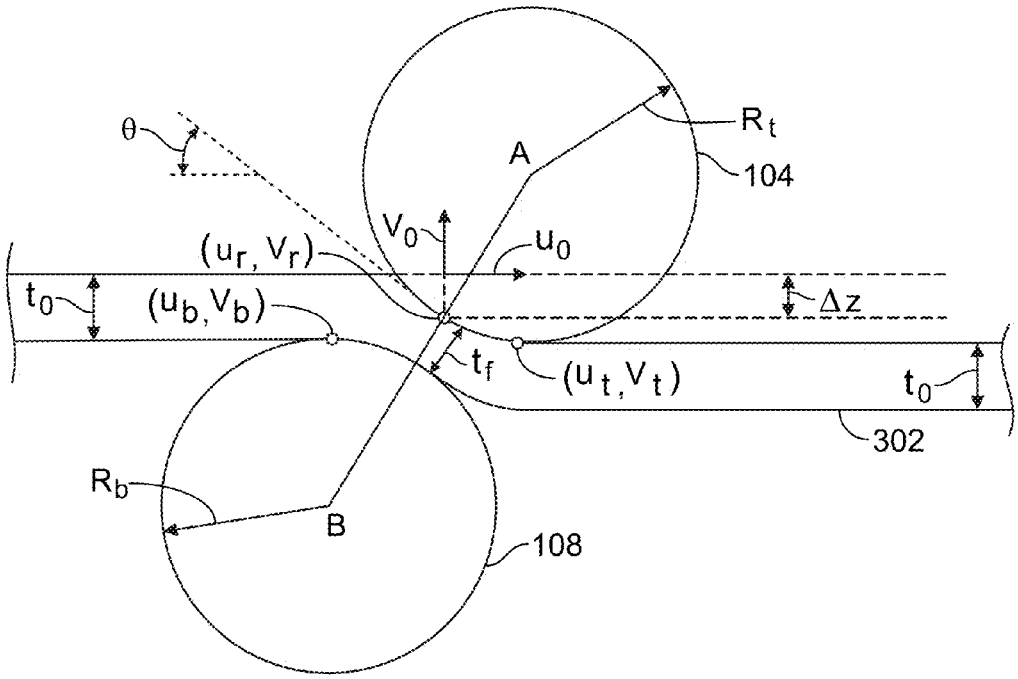
FIG. 8 is a schematic view of positioning the tools shown in FIG. 1 in accordance with one embodiment.

FIG. 8 is a schematic view of positioning the tools 104, 108 in accordance with another embodiment. Although the tools 104, 108 are shown as circles or spheres, alternatively, the tool 104 and/or 108 may have another shape. The contact point is shown at the coordinate location ($u_r$, $v_r$). The origin of the coordinate system shown in FIG. 8 is at ($u_0$, $v_0$) and the coordinates of the tips of the upper tool 104 and lower tool 108 are denoted as ($u_t$, $v_t$) and ($u_b$, $v_b$), respectively. The angle θ represents the angle made by the normal to the surface at the contact point with respect to a $v_0$ direction.

$R_t$ and $R_b$ represent the radii of the top and lower tools 104, 108, respectively. The deformed thickness of the sheet $t_f$ can be calculated using Equation 2 above, with d in Equation 2 representing $t_f$. This tool positioning strategy is based on ensuring that the tools 104, 108 are positioned such that the following constraints are met:

First, a straight line joining the centers of the tools is along the normal to the surface (e.g., line AB in FIG. 8) of the component at the contact point, i.e.:

$$V_b=v_r-(R_b+t_f)\cos\theta+R_b \quad \text{(Eqn. 5)}$$

Second, the tip of the lower tool 108 is on the bottom surface of the sheet 302, for example:

$$v_b=-t_0 \quad \text{(Eqn. 6)}$$

The variable $t_0$ can represent the thickness of the sheet 302 prior to deformation. Equations 2 and 3 can be combined to arrive at:

$$-t_0=v_r-(R_b+t_f)\cos\theta+R_b \quad \text{(Eqn. 7)}$$

If $v_r$ is equal to (−Δz), then Equation 7 may provide:

$$-t_0=-\Delta z-(R_b+t_f)\cos\theta+R_b \quad \text{(Eqn. 8)}$$

For a freeform component, the value of θ changes with Δz. If θ=f(Δz), then Equation 8 provides:

$$-t_0=\Delta z-(R_b+t_f)\cos(f(\Delta z))+R_b \quad \text{(Eqn. 9)}$$

For a DSIF operation, the pre-deformation sheet thickness $t_0$ may be a constant value that is based on a final use of the formed product. As a result, to satisfy Equation 9, there are one or more choices.

First, for a user supplied value of Δz, a value of $R_b$ may be selected that satisfies Equation 9. However, the function f(Δz) may not be explicitly known for freeform components. Moreover, even if the function is known, $R_b$ may need to change B throughout the component, such as for every contact point or many contact points. This may be infeasible since it could involve multiple repetitive tool changes for forming one component (e.g., possibly at each contact point).

Second, for a user supplied value of $R_b$, Equation 9 may be solved to find the value of Δz that satisfies Equation 9. However, for a freeform component, at a particular Δz, f(Δz) may need to be expressed explicitly for Equation 9 to be solved. This may not be possible due to the complexity of some freeform shapes. Moreover, this method can take control of Δz out of the control of an operator of the system 100. Since Δz also controls the surface finish and the formability, this method may not be generic in terms of forming freeform shapes with a required surface finish and without failure.

Figure 9:
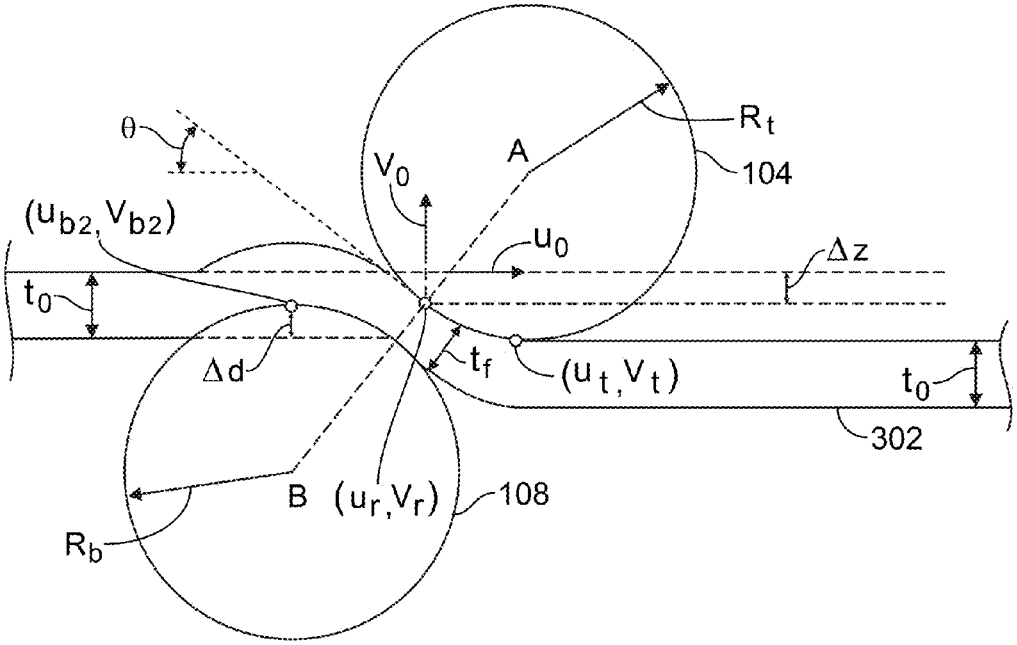
FIG. 9 is a schematic view of positioning the tools shown in FIG. 1 in accordance with one embodiment.

FIG. 9 is a schematic view of positioning the tools 104, 108 in accordance with another embodiment. One or more alternate strategies are used for positioning the two DSIF tools 104, 108 in order to provide toolpaths for ASDIF.

First, the constraint that the tip of the lower tool 108 has to be on the bottom surface of the sheet 302 may be relaxed. The straight line AB joining the centers of the tools 104, 108 is along the normal to the surface of the sheet 302. The values of Δz, $R_b$, and $R_t$ may be supplied or controlled by the operator of the system 100. The steps or operations for generating the toolpath in ADSIF are illustrated and described above in connection with FIGS. 5 through 7. For example, contact points and the corresponding normal are generated on a contour at a particular Z depth, $Z=Z_1$ (as shown in FIG. 3). The normal at each contact point has the same direction as line AB in FIG. 8 and therefore the value of θ at this contact point is determined.

The contact points are projected onto the Z=−Δz plane (e.g., as shown in FIG. 3) to obtain the contact point of the upper tool 104 on the sheet 302 (e.g., $u_r$, $v_r$). Therefore, the coordinates of each contact point ($u_r$, $v_r$) with respect to a origin coordinate system ($u_0$, $v_0$) are expressed by:

$$u_r=0 \quad \text{(Eqn. 10)}$$

$$v_r=-\Delta z \quad \text{(Eqn. 11)}$$

For each contact point, the coordinates of the tool tips for the upper tool 104 (e.g., $u_t$, $v_t$) and the lower tool 108 (e.g., $u_b$, $v_b$) are calculated according to:

$$u_t=u_r+R_t\sin\theta \quad \text{(Eqn. 12)}$$

$$v_t=v_r+R_t(\cos\theta-1) \quad \text{(Eqn. 13)}$$

$$u_b=u_r-(R_b+t_f)\sin\theta \quad \text{(Eqn. 14)}$$

$$v_b=v_r-(R_b+t_f)\cos\theta+R_b \quad \text{(Eqn. 15)}$$

The deformed thickness of the sheet $t_f$ can be calculated based on Equation 2, as described above. The above strategy can allow the operator of the system 100 to be able to control the value of Δz for a variety of freeform or axisymmetric components and/or for a variety of tool radii.

Second, another strategy relaxes the constraint that the centers of the two tools 104, 108 have to be in a straight line that is along the normal to the desired surface at the contact point. One constraint may be that the tip of the lower tool 108 is on the bottom surface of the sheet 302. By incorporating this constraint, this strategy (as shown in FIG. 8) ensures that the lower tool 108 does not push up into the sheet (e.g., Δd in FIG. 9 is relatively small or zero). The coordinates for the upper tool 104 can be are calculated from Equations 12 and 13. The coordinates of the lower tool 108 (e.g., $u_{b2}$, $v_{b2}$) can be calculated using:

$$u_{b2}=u_r-(R_b+t_f)\sin\theta-\Delta d\tan\theta \quad \text{(Eqn. 16)}$$

$$v_{b2}=v_r-(R_b+t_f)\cos\theta+R_b=\Delta d \quad \text{(Eqn. 17)}$$

Therefore, unlike the previously described strategy, the lower tool 108 may not push the sheet 302 up in the $v_0$ direction.

In certain embodiments discussed above, a straight line connecting the hemispheres of the tools does not pass through the desired contact point. For example, FIGS. 10 and 11 provide schematic views of positioning the tools 104, 108 in accordance with one embodiment.

Figure 10:
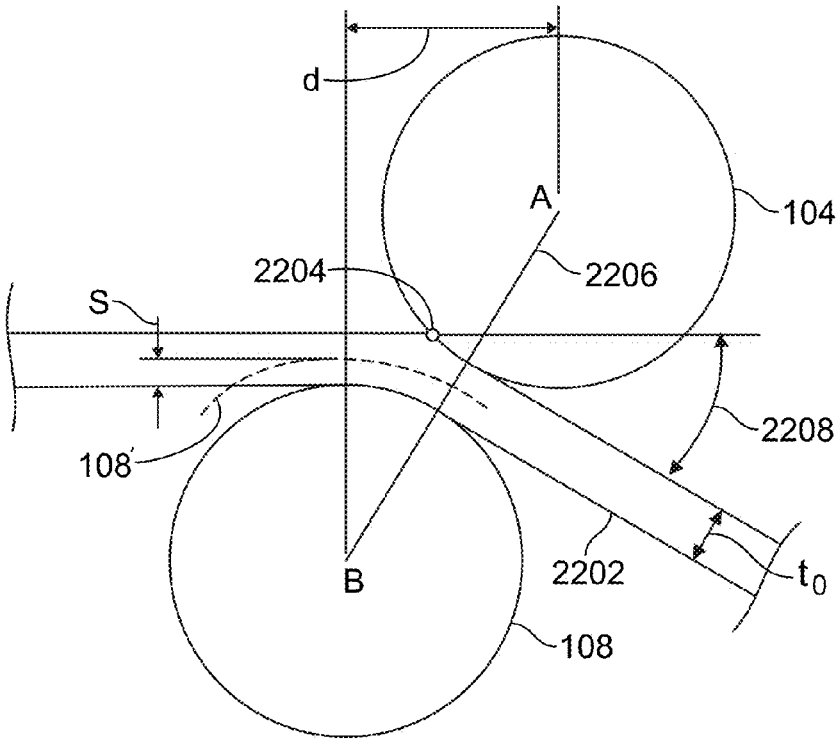
FIG. 10 provides a schematic view of positioning the tools shown in FIG. 1 in accordance with one embodiment.
Figure 11:
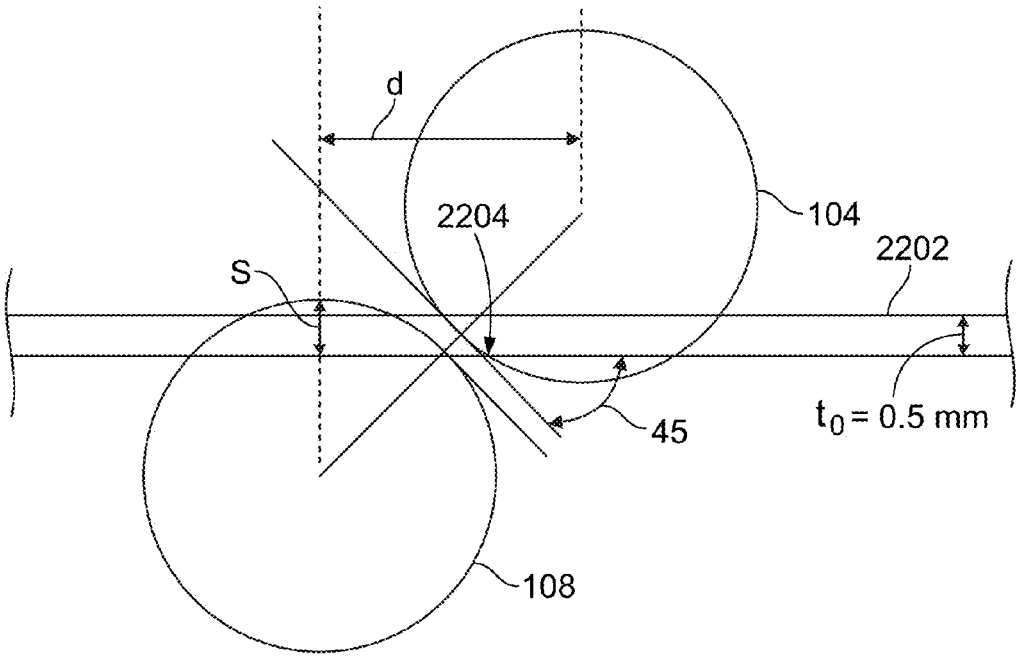
FIG. 11 provides another schematic view of positioning the tools shown in FIG. 1 in accordance with one embodiment.

In the embodiment of FIGS. 10 and 11, the upper tool 104 and the lower tool 108 are positioned on either side of a sheet 2202 (e.g., the sheet 302). The sheet 2202, may be formed, for example, of AA2024 material, and have a thickness $t_0$ of 0.5 millimeters (or another thickness). In FIG. 10, the position of the upper tool 104 is fixed based upon local geometry and the Δz value desired. A desired or designated contact point 2204 identifies a location on the sheet 2202 from which an angle 2208 will be measured, and thus in embodiments may also be considered as a location for the beginning of a bend in the metal sheet 2202. The desired contact point 2204 is generally located proximal to an edge of contact between the metal sheet 2202 and the upper tool 104.

The distance S represents the distance that the lower tool is advanced in a direction toward the sheet 2202 the upper tool 104 (in the view of FIG. 10) beyond the orientation at which the sheet 2202 is initially brought into contact with the upper tool 104 at the desired contact point 2204. In one embodiment, the distance S can represent the incremental depth Δz described aove. For example, the upper tool 104 and the lower tool 108 are positioned such that the lower tool 108 has been urged upwardly to a position where a top surface of the sheet 2202 has been brought into contact with the upper tool 104 at the contact point 2204. In the illustrated embodiment, the contact point 2204 is not located along a line 2206 (shown in FIG. 10) joining the centers of the hemispheres of the upper tool 104 and lower tool 108. The distance S represents the extent the lower tool 108 is urged further upwardly from the position shown in FIG. 10. In embodiments, S may be zero or about zero, indicating that the lower tool 108 has been urged upwardly to a position where the contact point 2204 is brought into contact with the upper tool 104 and no further. In the illustrated embodiment, the distance S represents the vertical distance between the lower tool 108 in the position described above and shown in FIG. 10) and the bottom tool 108' in a position where the bottom tool 108 has been urged upwardly (as shown in FIG. 10.

The distance D shown in FIGS. 10 and 11 represents the horizontal or lateral distance (in the perspective of FIG. 10) between the centers of the hemispheres of the tools 104, 108. Appropriate values of S and D may then be calculated to obtain the desired or final ending shape of the sheet 2202. For example, appropriate values for a given combination of tools, sheet thickness, sheet material, and desired shape may be determined experimentally, or otherwise, for example, through simulations, or as another example, through analytic calculations based on information obtained from simulations. Further still, other parameters than D and S may be used in different embodiments to describe the positions of the tools 104, 108. For example, parameters may be defined with respect to other reference points or positions.

Figure 12:
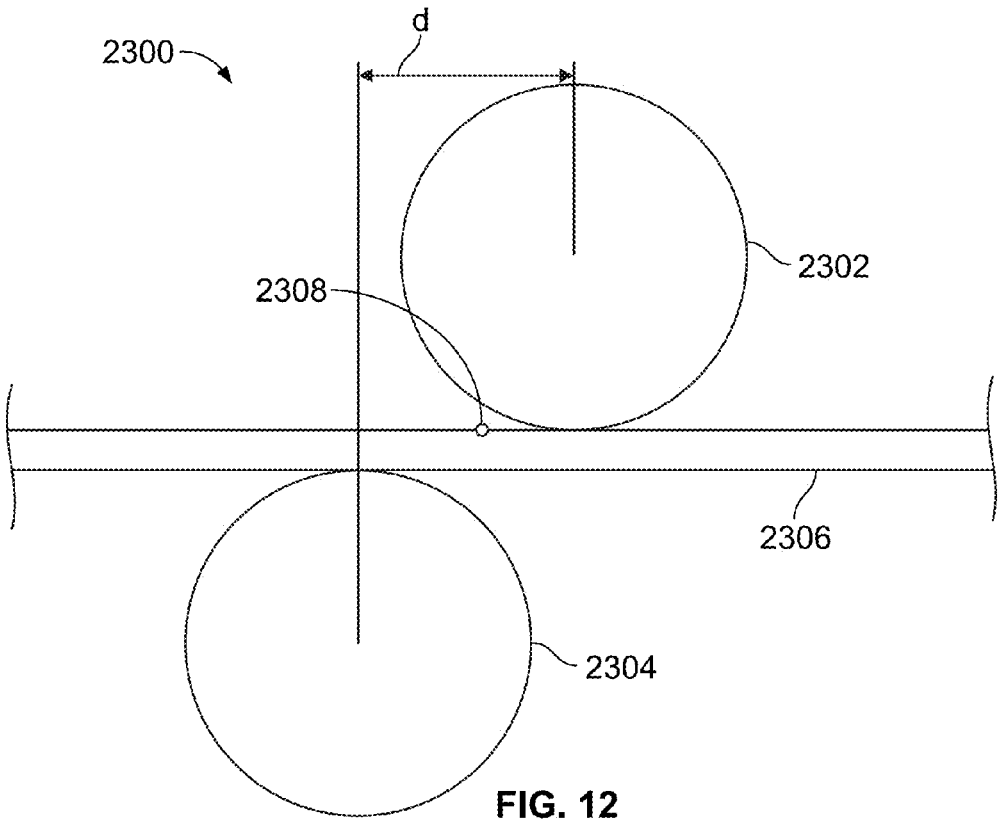
FIG. 12 illustrates a schematic view of an example of a metal forming operation in accordance with one embodiment.
Figure 13:
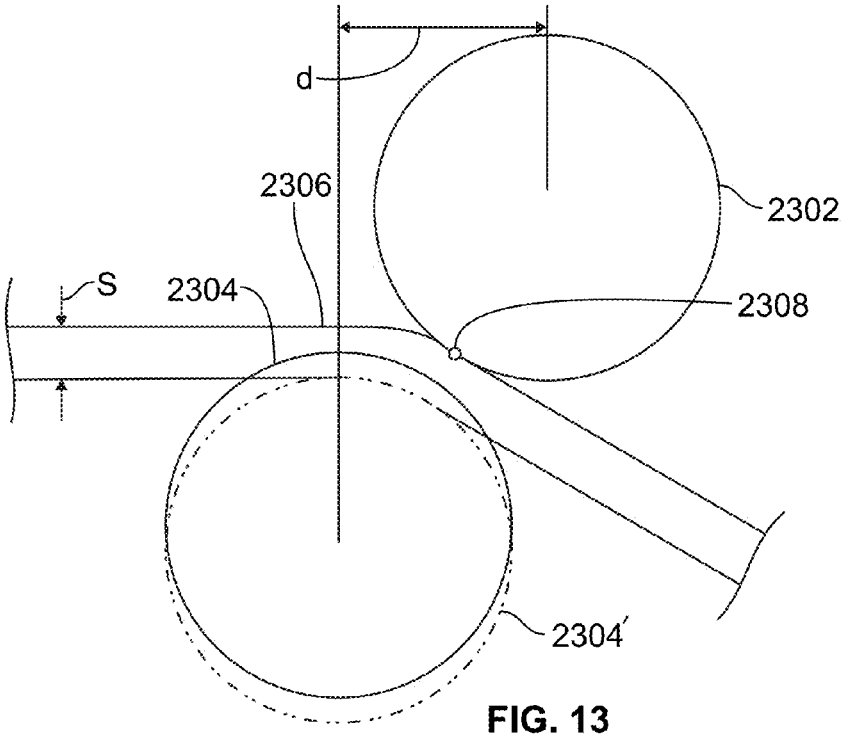
FIG. 13 illustrates a schematic view of an example of a metal forming operation in accordance with one embodiment.
Figure 14:
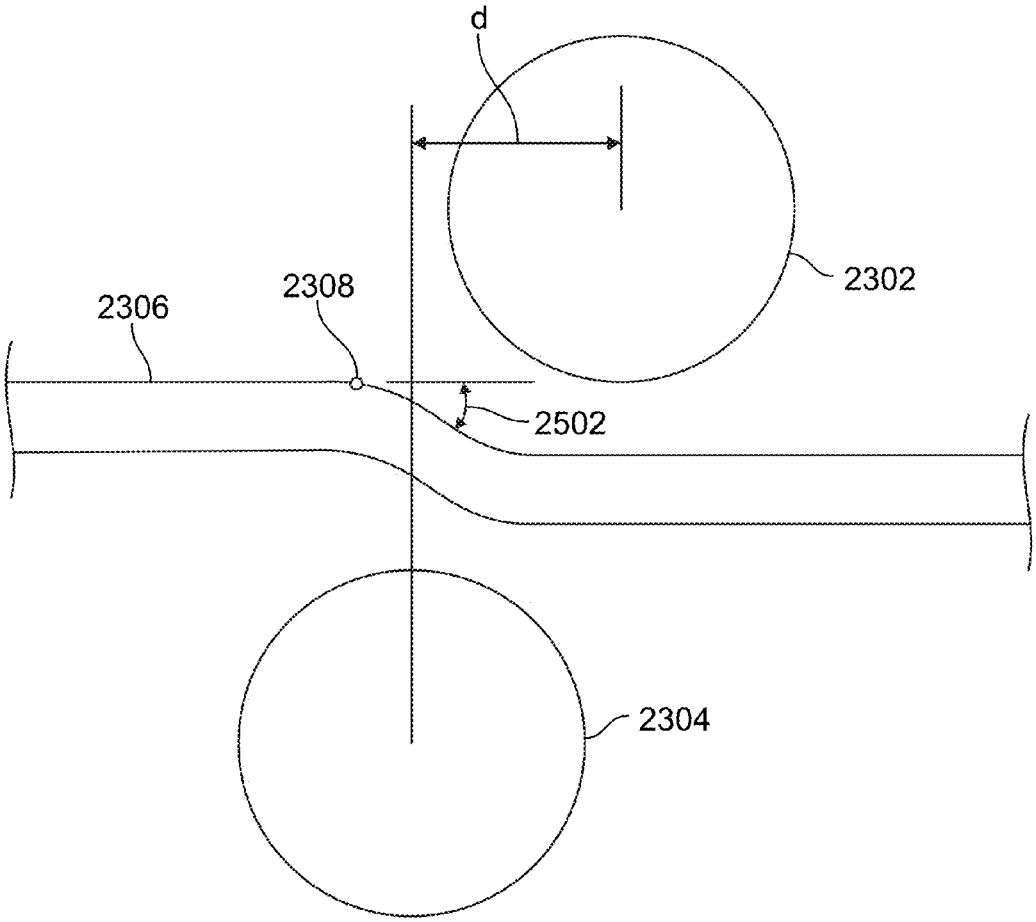
FIG. 14 illustrates a schematic view of an example of a metal forming operation in accordance with one embodiment.
Figure 15:
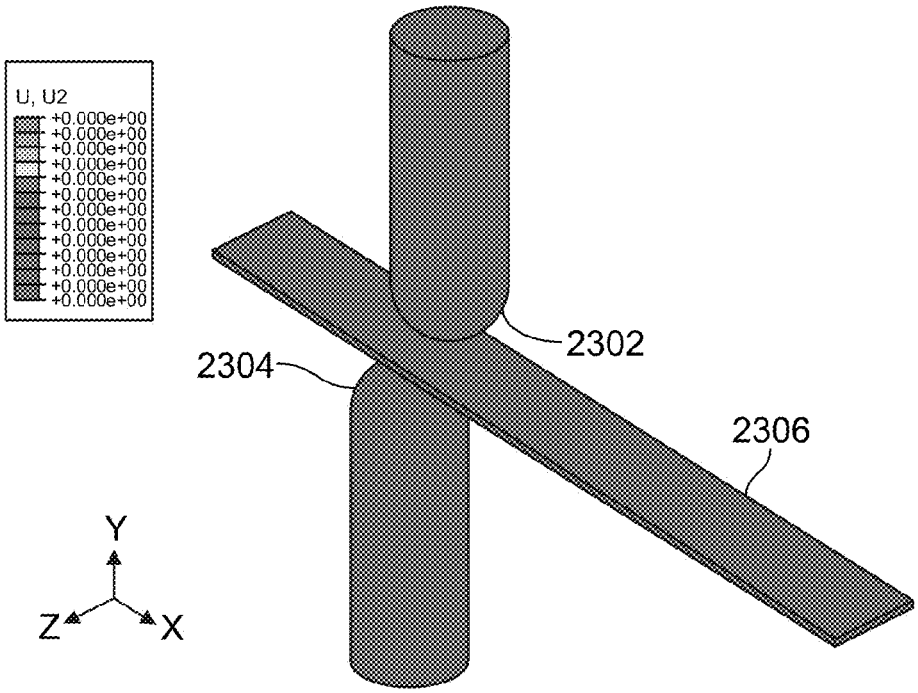
FIG. 15 illustrates a perspective view of the example shown in FIG. 12.

FIGS. 12, 13, and 14 illustrate schematic views of an example of a metal forming operation in accordance with embodiments. FIGS. 15, 16, 17, and 18 illustrate perspective views of the operation that correspond with the schematic views of FIGS. 12, 13, and 14. FIG. 15 corresponds to the view of FIG. 12, FIG. 16 corresponds to the view of FIG. 13, and FIGS. 17 and 18 correspond with the view of FIG. 14. A forming system 2300 includes a upper tool 2302, a lower tool 2304, and a sheet 2306. The system 2300 may correspond to a portion of the system 100 that includes the tool 104 (represented by the tool 2302) and the tool 108 (represented by the tool 2304). The sheet 2306 may represent the sheet 302, and includes a desired or designated contact point 2308, and is to be bent to a desired angle measured from the contact point 2308. For the below discussed examples, the tools 2302, 2304 have a diameter of about 5 millimeters (or another diameter), the sheet 2306 is a beam of AA2024 material clamped at both ends having a thickness of about 0.5 millimeters (or another thickness), and the desired angle is 45 degrees. In FIGS. 12 and 15, the upper tool 2302 and lower tool 2304 are positioned so that each is just touching a respective top and bottom surface of the sheet 2306.

Figure 16:
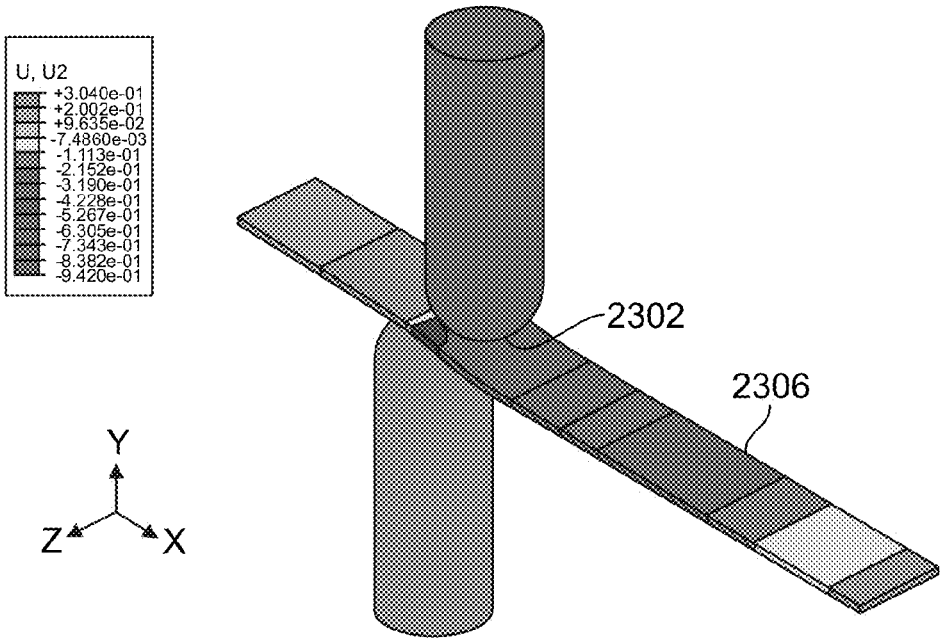
FIG. 16 illustrates a perspective view of the example shown in FIG. 13.

In FIGS. 13 and 16, with upper tool 2302 remaining in place, the lower tool 2304 is urged upwardly to the point where the contact point 2308 first contacts the upper tool 2302, and beyond. FIGS. 13 and 16 depict a position of the tools 2302, 2304 during deformation of the sheet 2306. The lower tool is shown in FIG. 13 as 2304 and 2304', which represent different positions of the lower tool. The lower tool 2304' in FIG. 13 represents the position of the lower tool when the contact point 2308 first contacts the upper tool 2302, and the lower tool 2304 shown in FIG. 13 represents the uppermost vertical position of the lower tool. S represents the vertical displacement between 2304 and 2304'. D represents the horizontal distance between the centers of the hemispheres of the tools 2302, 2304. In certain embodiments, S may be zero (where the lower tool 2304 is not urged upwardly beyond the point where the contact point 2308 is brought into contact with the upper tool 2302. Again, additional or other parameters representing the various positions may be employed in alternate embodiments.

Figure 17:
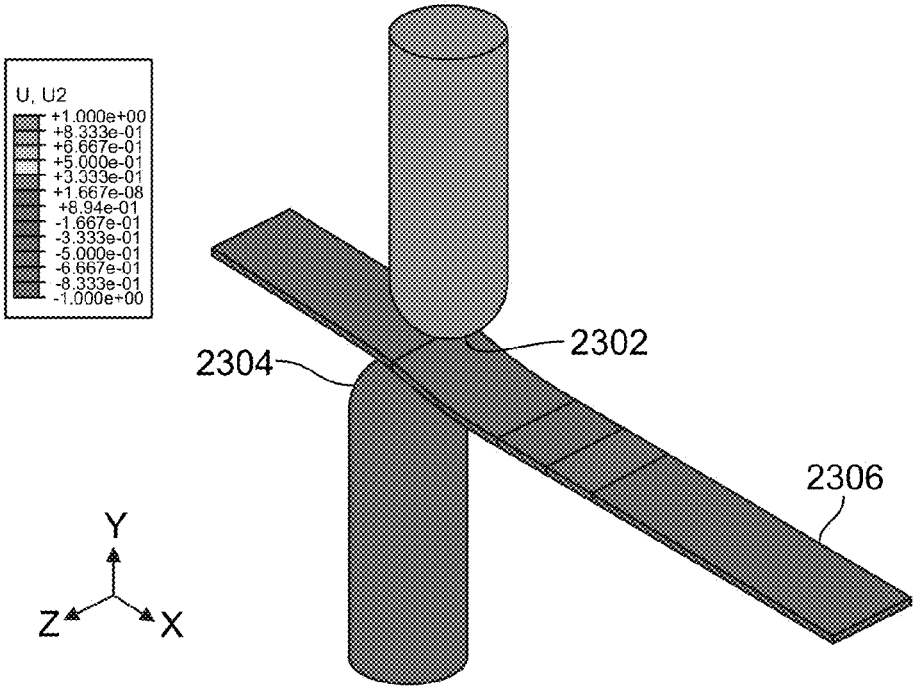
FIG. 17 illustrates a perspective view of the example shown in FIG. 14.
Figure 18:
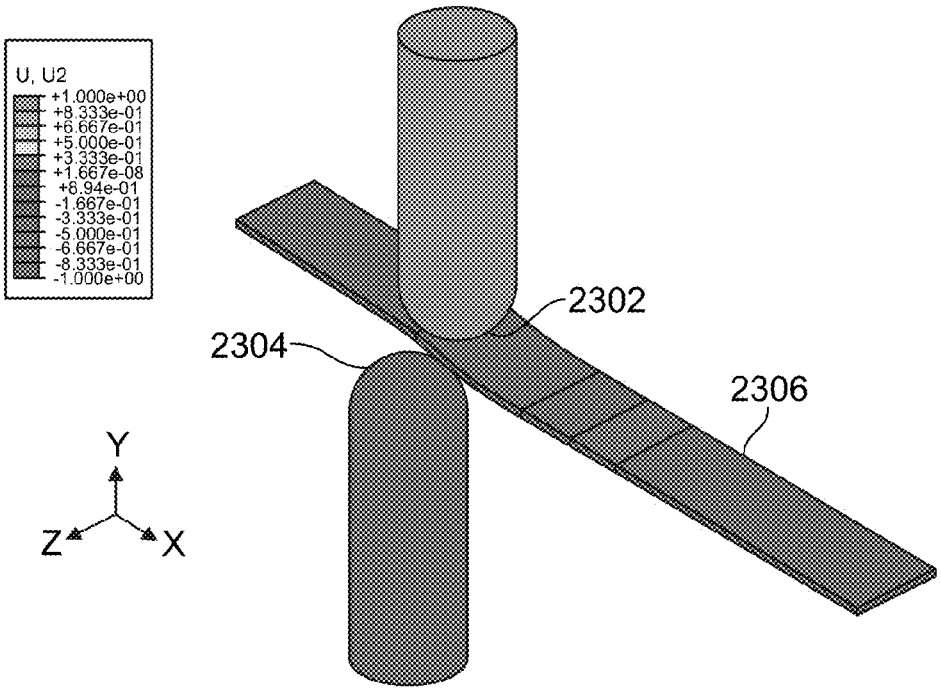
FIG. 18 illustrates another perspective view of the example shown in FIG. 14.

In FIGS. 14, 17, and 18, which depict positions of the tools 2302, 2304 during a release step where the tools 2302, 2304 are disengaged from the sheet 2306, the tools 2302, 2304 are shown as being removed from contact with the sheet 2306 so that a deformation angle 2502 may be measured. The deformation angle 2502 is measured from the contact point 2308. By measuring the deformation angle 2502 for various combinations of S and D, and comparing the deformation angle 2502 with a desired or designated angle, combinations of S and D may be experimentally determined that provide desired results for a given combination of, for example, tool size and configuration, sheet thickness and material, and desired angle of the shape's wall. For a freeform shape different combinations of D and S values may then be used in different portions of the toolpath to attain a desired local wall angle.

FIGS. 19 through 26 depict schematic views of the system 2300 and results of simulations of the system 2300 in accordance with one example. FIGS. 19, 21, 23, and 25 schematically illustrate the tools 2302, 2304 in various positions deforming the sheet 2306 using different values of S and D, and FIGS. 20, 22, 24, and 26 illustrate simulations of the plastic strains in the sheet 2306 for the positions of the tools 2302, 2304 in the corresponding FIGS. 19, 21, 23, and 25.

Figure 19:
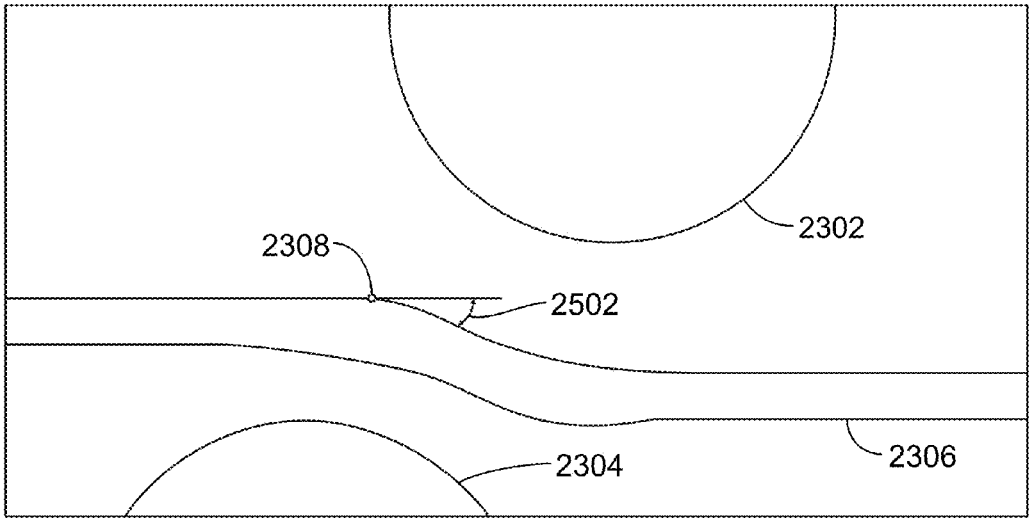
FIG. 19 depicts a schematic view of a forming system and results of simulations of the system in accordance with one example.
Figure 20:
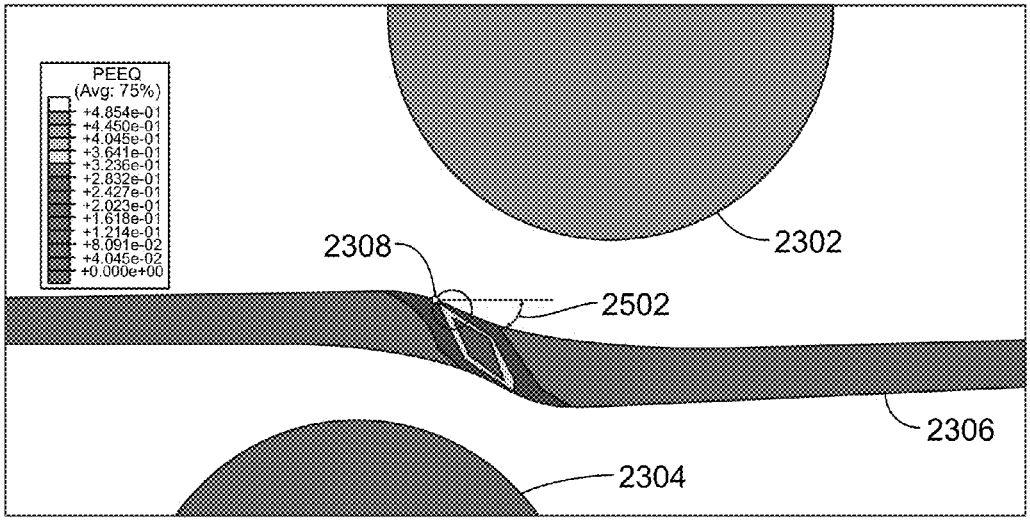
FIG. 20 depicts another schematic view of the forming system and results of simulations of the system in accordance with another example.

For the simulation shown in FIGS. 19 and 20, values of S=0 and D=2.7 millimeters were employed. After deformation of the sheet 2306, the tools 2302, 2304 were removed and the results obtained. The resulting angle 2502 (measured from the desired contact point 2308) was found to be about 39 degrees.

Figure 21:
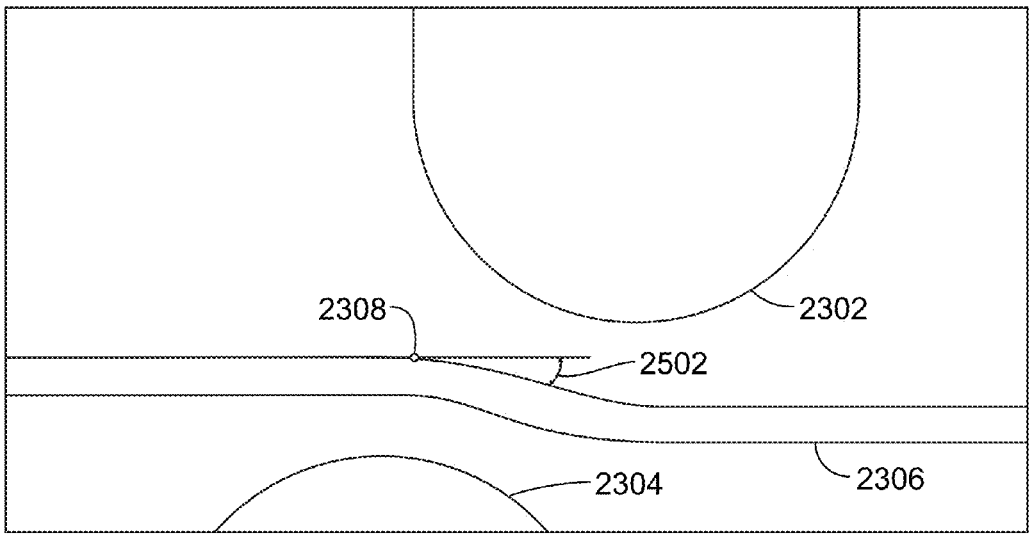
FIG. 21 depicts another schematic view of the forming system and results of simulations of the system in accordance with another example.
Figure 22:
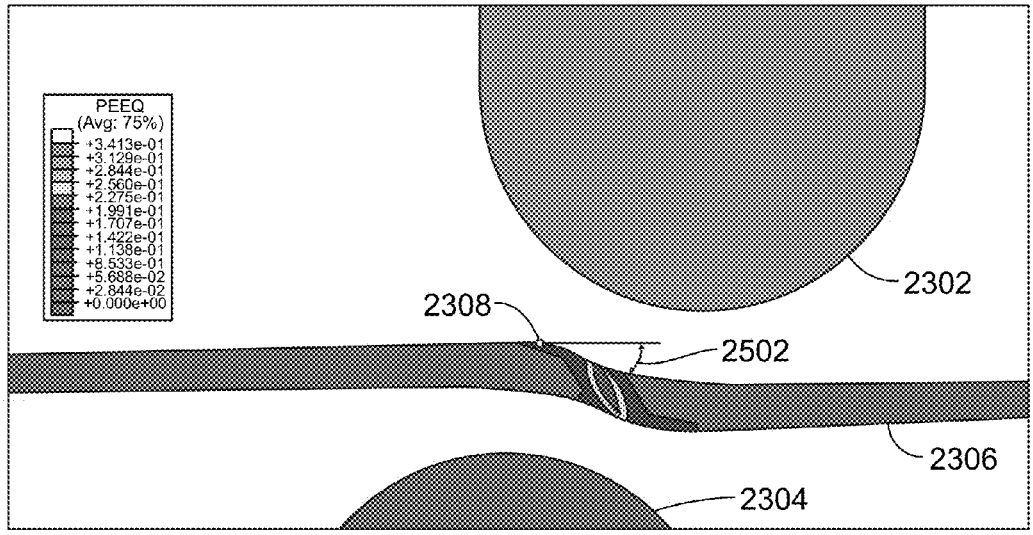
FIG. 22 depicts another schematic view of the forming system and results of simulations of the system in accordance with another example.

For the simulation shown in FIGS. 21 and 22, values of S=0 and D=2.8 millimeters were employed. After deformation of the sheet 2306, the tools 2302, 2304 were removed and the results obtained. The resulting angle 2502 (measured from the desired contact point 2308) was found to be about 35 degrees.

Figure 23:
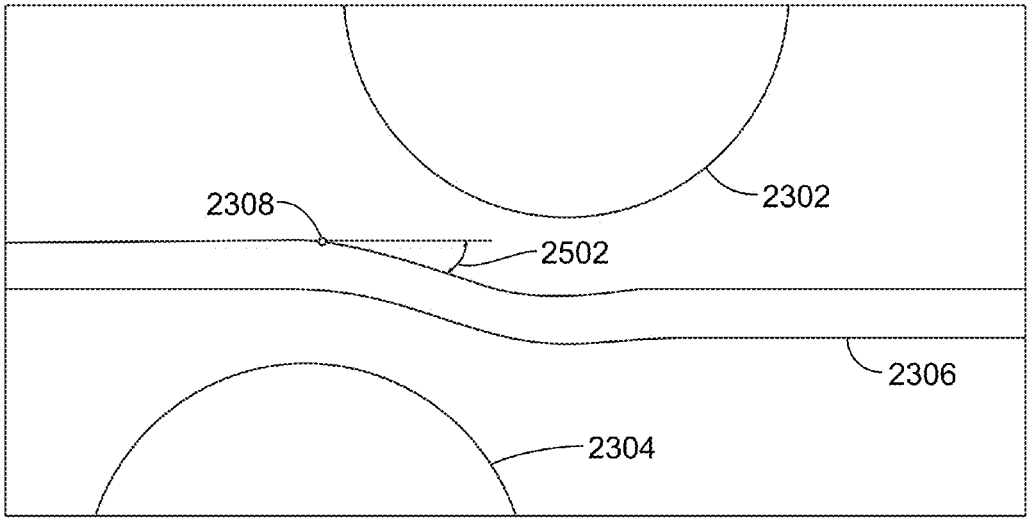
FIG. 23 depicts another schematic view of the forming system and results of simulations of the system in accordance with another example.
Figure 24:
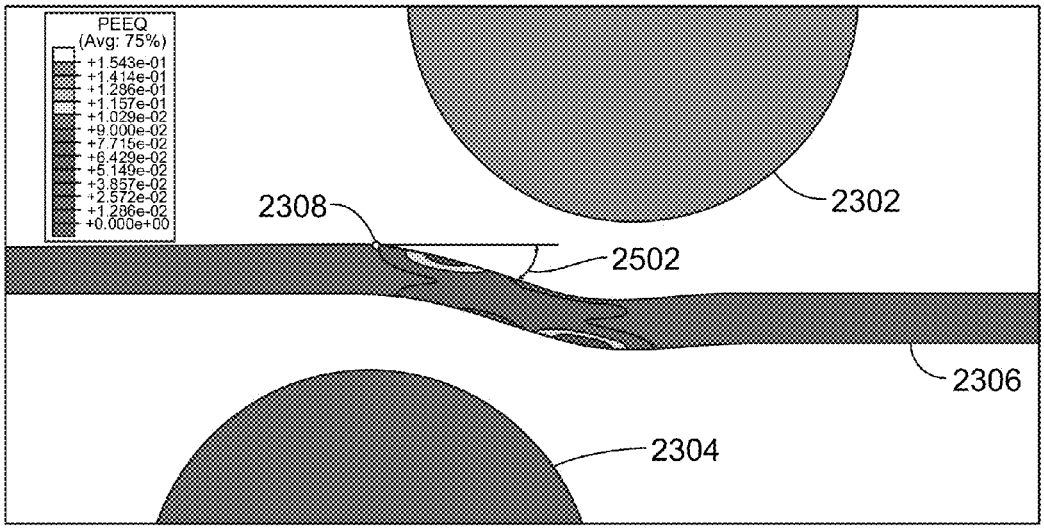
FIG. 24 depicts another schematic view of the forming system and results of simulations of the system in accordance with another example.

For the simulation shown in FIGS. 23 and 24, values of S=0 and D=3.0 millimeters were employed. After deformation of the sheet 2306, the tools 2302, 2304 were removed and the results obtained. The resulting angle 2502 (measured from the desired contact point 2308) was found to be about 20 degrees. In one embodiment, a plastic hinge was observed to develop in the sheet 2306 proximate to the desired contact point 2308 with the values of S=0 and D=3.0 millimeters being used. The deformation zone (e.g., the portion of the sheet 2306 that was deformed) was observed to swing, or pivot, about the plastic hinge at or near the contact point 2308 upon removal of the tools 2302, 2304.

Figure 25:
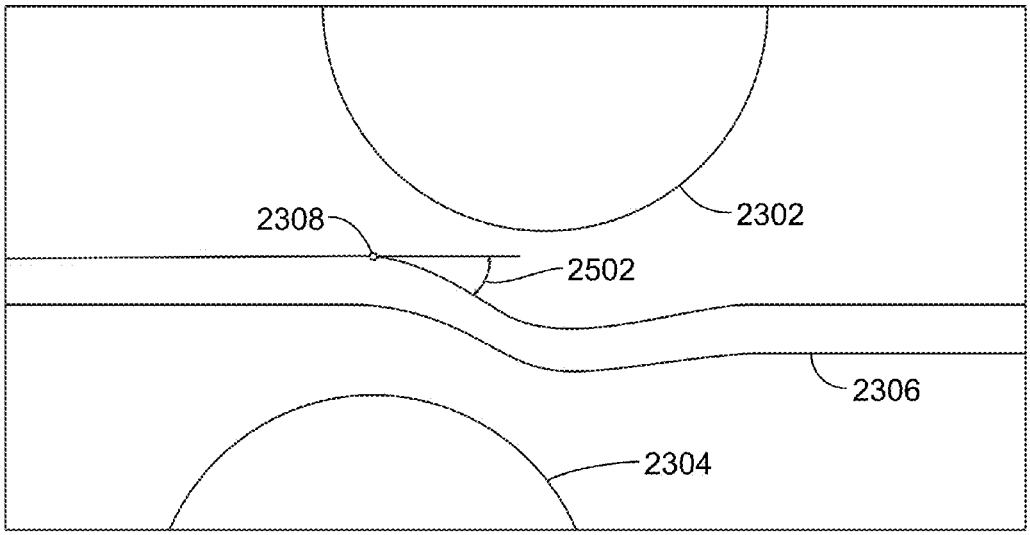
FIG. 25 depicts another schematic view of the forming system and results of simulations of the system in accordance with another example.
Figure 26:
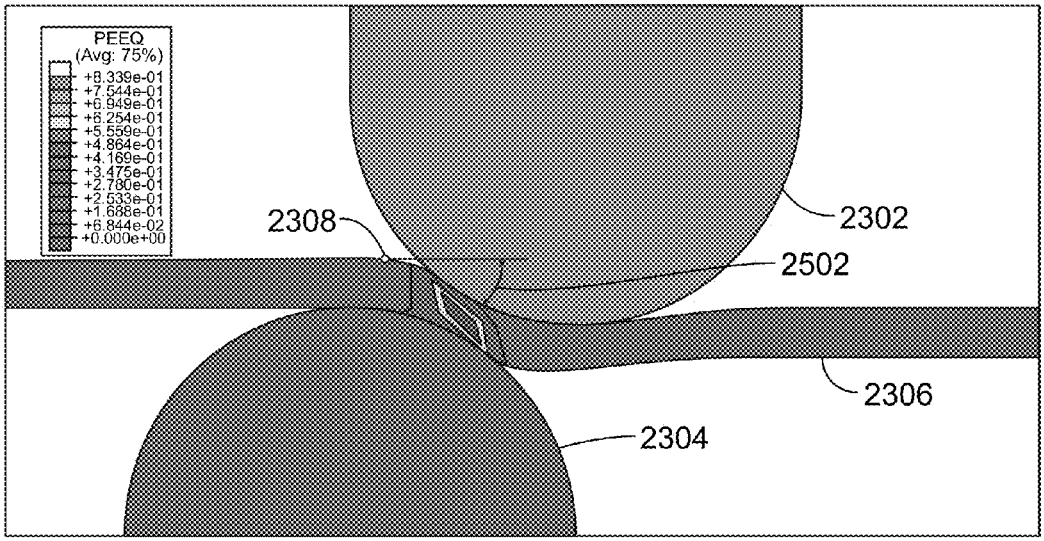
FIG. 26 depicts another schematic view of the forming system and results of simulations of the system in accordance with another example.

For the simulation shown in FIGS. 25 and 26, values of S=0.2 and D=2.8 millimeters were employed. After deformation of the sheet 2306, the tools 2302, 2304 were removed and the results obtained. The resulting angle 2502 (measured from the desired contact point 2308) was found to be about 43 degrees.

Figure 27:
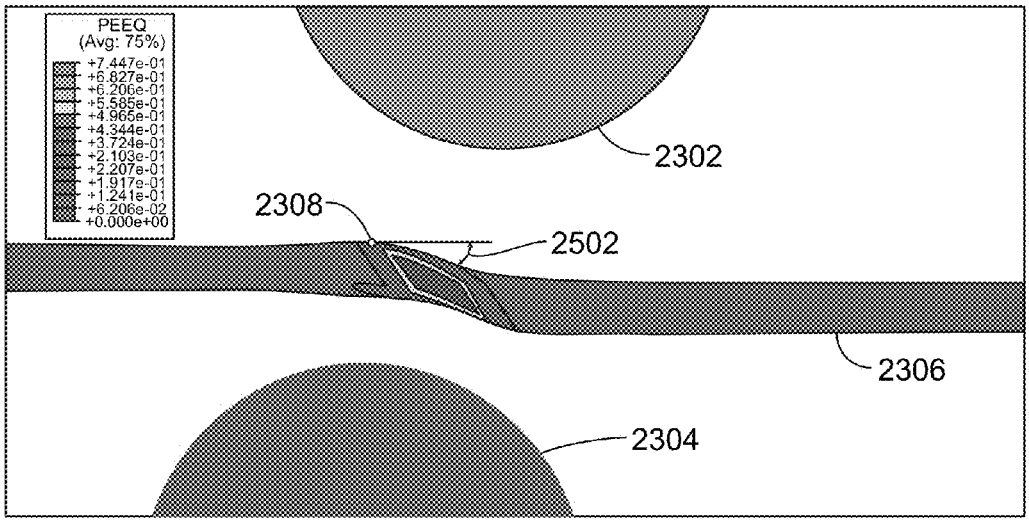
FIG. 27 depicts another schematic view of the forming system and results of simulations of the system in accordance with another example.
Figure 28:
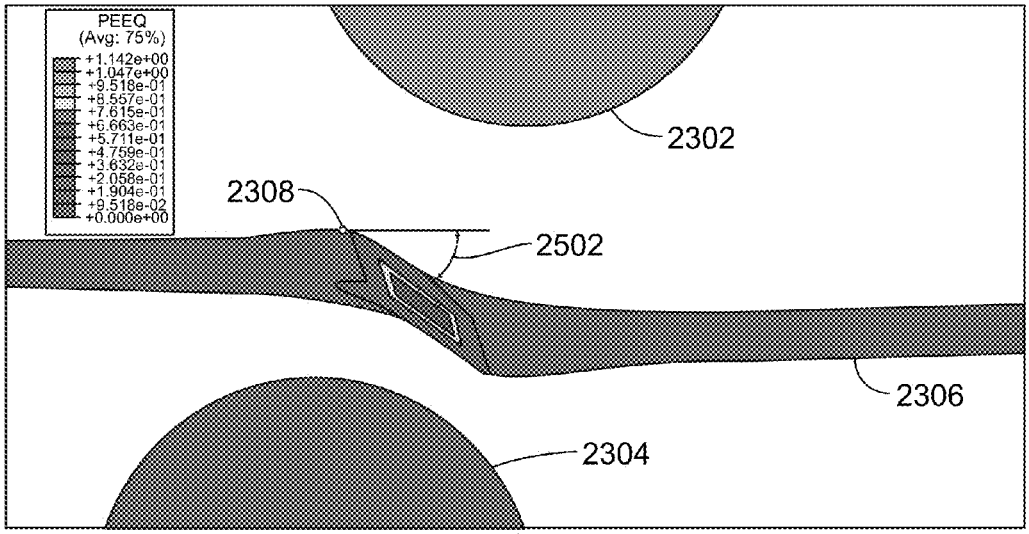
FIG. 28 depicts another schematic view of the forming system and results of simulations of the system in accordance with another example.

One or more preferred combinations may be determined in this way for combinations of S and D where the lower tool 2304 is not urged upwardly too far into the sheet 2306 while still being able to control the incremental depth of the deformation. Combinations of S and D can be determined by performing simulations for a given combination of tool characteristics, sheet characteristics, and desired shape (for example, a given combination of wall angle, tool diameter, sheet properties and Δz). In embodiments, after a combination is found, for example, analytic calculations may be performed to determine one or more additional combinations based on parameters, such as those mentioned above. Examples of such combinations are shown in FIGS. 27 and 28. In FIG. 27, the angle 2502 was desired to be 30 degrees and, using values of D=1.7 millimeters and S=0.0408 millimeters, the actual measured angle 2502 is 31 degrees. In FIG. 28, the angle 2502 was desired to be 45 degrees and, using values of D=2.46 millimeters and S=0.09077 millimeters, the actual measured angle 2502 is 46 degrees.

In alternate embodiments, different combinations of parameters may be employed, for example, to describe the various settings of the tools. For example, parameters defining positions of the tools in horizontal or vertical directions with respect to each other may be taken from additional or different reference points, or defined at different or additional times.

Figure 29:
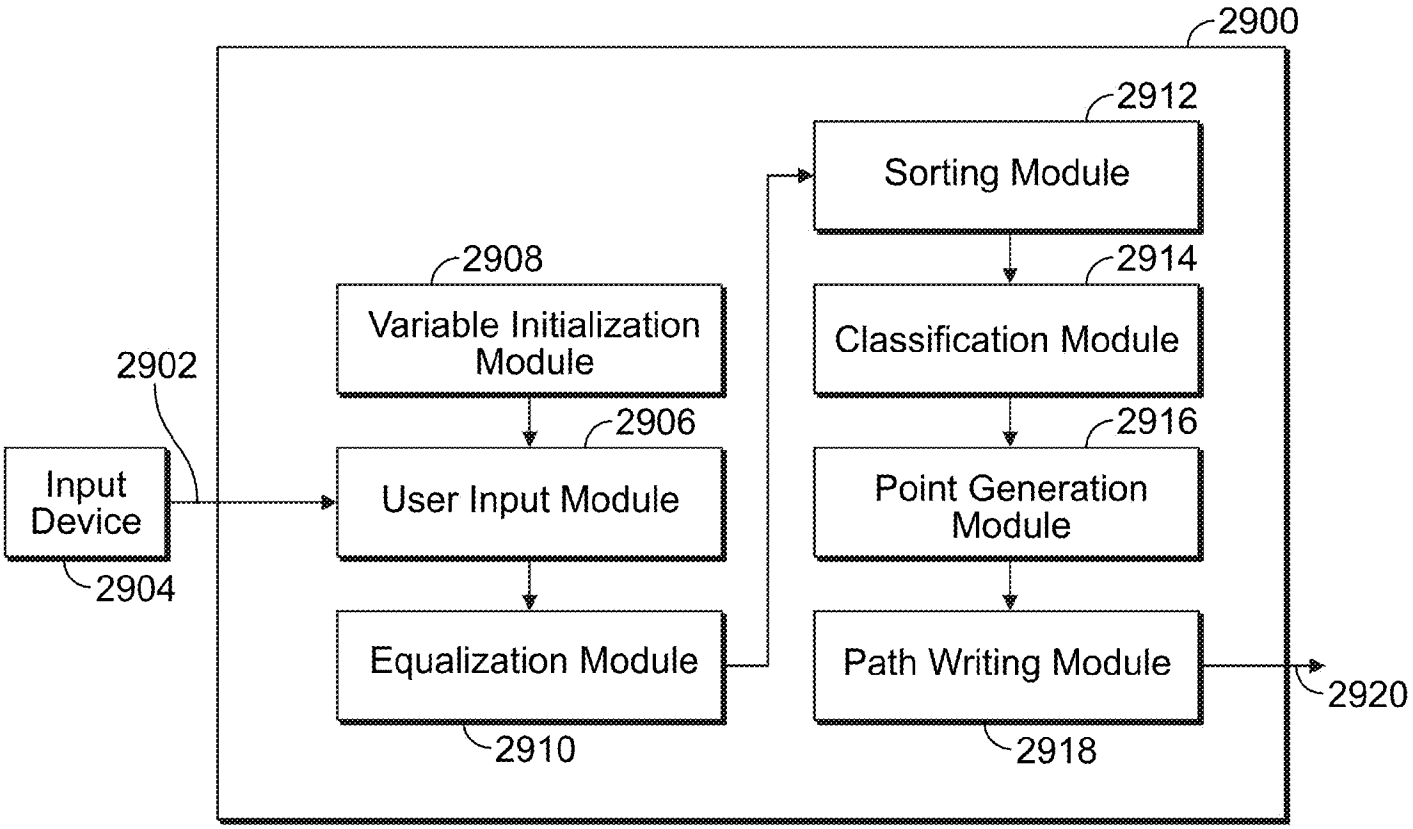
FIG. 29 is a schematic illustration of one embodiment of a control unit that may be used control the forming system shown in FIG. 1.

FIG. 29 is a schematic illustration of one embodiment of a control unit 2900 that may be used control the forming system 100 and/or 2300. The control unit 2900 may represent the control unit 116 of the system 100 shown in FIG. 1. The control unit 2900 receives an input signal 2902 that is generated by an input device 2904, such as a keyboard, touchscreen, stylus, connector or connector port (e.g., to receive a data signal from another connector or memory device), microphone, or the like. The input signal 2902 can include one or more parameters for operating the system 100, 2300 to form a three dimensional component from a planar sheet of material, such as described above in connection with FIGS. 1 through 28. The input signal 2902 can include one or more of a shape of the desired component (e.g., a Computer Aided Design, or CAD, model of a surface to be formed from the sheet); an incremental depth (Δz), such as the distance that the sheet is to be deformed with each movement of one or more of the tools 104, 108, 2302, 2304 in the Z direction 122; the diameters (or other sizes) of the portions of the tools 104, 108, 2302, 2304 that engage the sheet (e.g., $td_{top}$ for the tool 104, 2302 and $td_{bottom}$ for the other tool 108, 2304); one or more distances between points where the tools 104, 108, 2302, 2304 engage and deform the sheet (e.g., Δc); a minimum incremental depth (e.g., $\Delta z_c$); values of S and/or D; a number of axes or degrees of freedom of movement of the tools 104, 108, 2302, 2304 (e.g., three DOF tools or six DOF tools); and the like.

A user input module 2906 of the control unit 2900 receives the input signal 2902 from the input device 2902, such as through one or more wired and/or wireless connections. The input device 2902 routes the information contained in the input signal 2902 to the various other modules of the control unit 2900 as the information is requested or needed by the modules to perform the operations associated with the modules.

A variable initialization module 2908 assigns, resets, or otherwise sets values to various parameters used by the control unit 2900 to create toolpaths for the tools 104, 108, 2302, 2304. The variable initialization module 2908 can base the values of some parameters using the user-provided input and/or can set the values of parameters to a default value. By way of example, the variable initialization module 2908 can set a value of a current depth $z_1$ to be zero. The current depth $z_1$ represents the current depth of the component. Because forming has not yet begun, this value is set to zero. The variable initialization module 2908 can set counters of the number of features, slices (e.g., two-dimensional sections of the component to be formed), and the like, to be zero as well.

An equalization module 2910 can be provided to ensure that transitions between features formed at different planes (e.g., different incremental depths) is consistent between the different planes. In one embodiment, the equalization module 2910 modifies the incremental depth Δz in order to ensure smooth transitions between the features. For example, the intersection of a three-dimensional CAD surface model of the desired component with a plane (e.g., an XY plane, such as a plane having a normal in the Z direction 122) can produce one or more closed curves. If these intersections are found using two or more planes (e.g., a first plane and a second plane) at respective first and second heights $z_1$ and $z_2$, then one or more sets of curves can be generated for each of the planes. To ensure that the transitions between these intersections at the different planes are continuous in the space between the planes, the equalization module 2910 may set or change the incremental depth Δz such that the number of curves in each of the neighboring planes (e.g., planes that are separated by the incremental depth Δz) is equal to each other.

Figure 30:
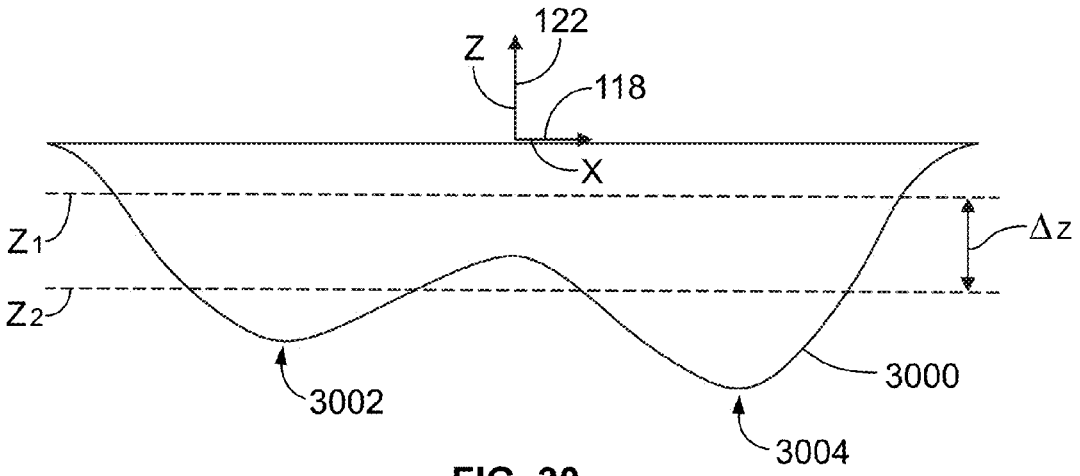
FIG. 30 is a side view of one example of a surface model for a desired component that is to be formed using the control unit shown in FIG. 29.

FIG. 30 is a side view of one example of a surface model 3000 for a desired component that is to be formed using the control unit 2900. While the discussion herein may focus on the model 3000, other models also may be used. The model 3000 may be provided as an input to the control unit 2900, such as from an operator. The equalization module 2900 can determine the number of curves that are formed in each of cross-sectional planes $z_1$ and $z_2$ that extend through the model 3000 and that are separated from each other by the incremental depth $\Delta z$.

Figure 31:
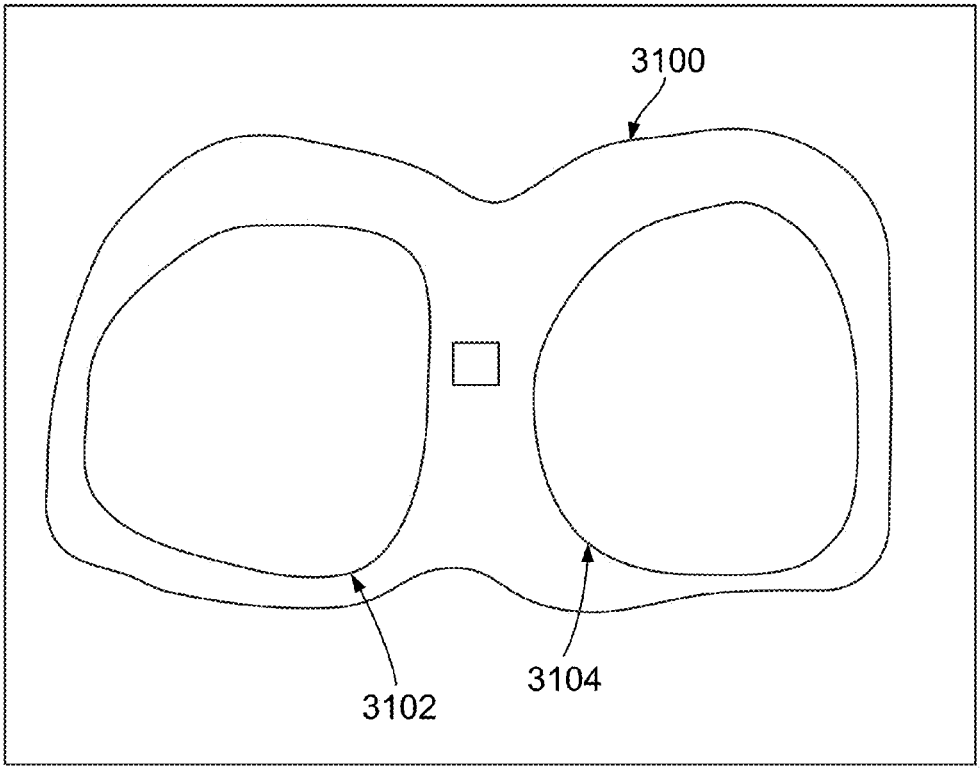
FIG. 31 is a combined view of the cross-sections of the model shown in FIG. 30 at the planes $z_1$ and $z_2$.

FIG. 31 is a combined view of the cross-sections of the model 3000 at the planes $z_1$ and $z_2$. As shown in FIG. 31, the equalization module 2900 determines that there are two curves 3102, 3104 defined by the intersection of the model 3000 and the plane $z_2$ but only a single curve 3100 defined by the intersection of the model 3000 and the plane $z_1$.

The equalization module 2900 compares the number of curves identified in the neighboring planes $z_1$ and $z_2$ and determines that the number of curves in each plane are different. As a result, the equalization module 2900 reduces the incremental depth $\Delta z$ between the planes $z_1$ and $z_2$. For example, the equalization module 2900 can reduce the incremental depth $\Delta z$ by one fourth (or by another number or fraction). The equalization module 2900 can then examine the curves defined by the intersections of the planes $z_1$ and $z_2$ with the model 3000 that are now separated by the smaller incremental depth $\Delta z$.

Figure 32:
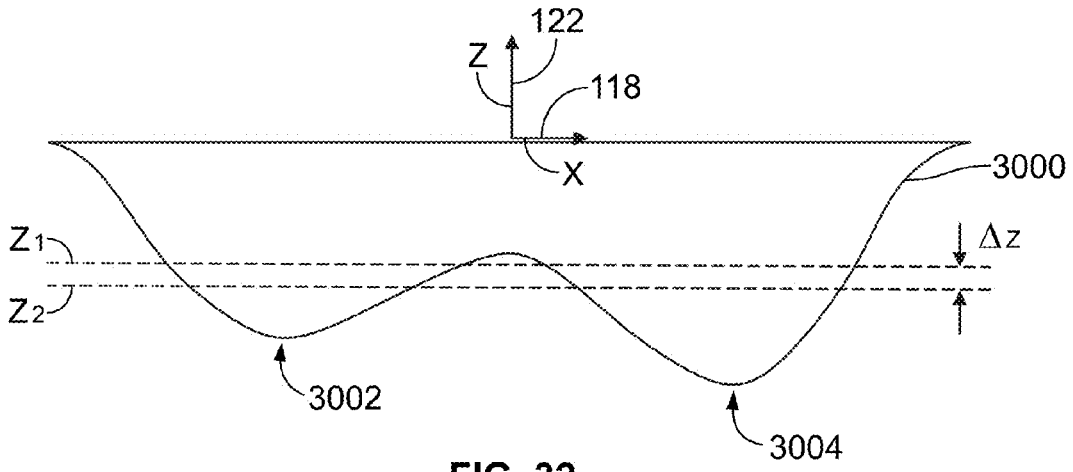
FIG. 32 is a side view of the surface model shown in FIG. 30 and the neighboring planes $z_1$ and $z_2$ that are separated by the reduced incremental depth $\Delta z$.
Figure 33:
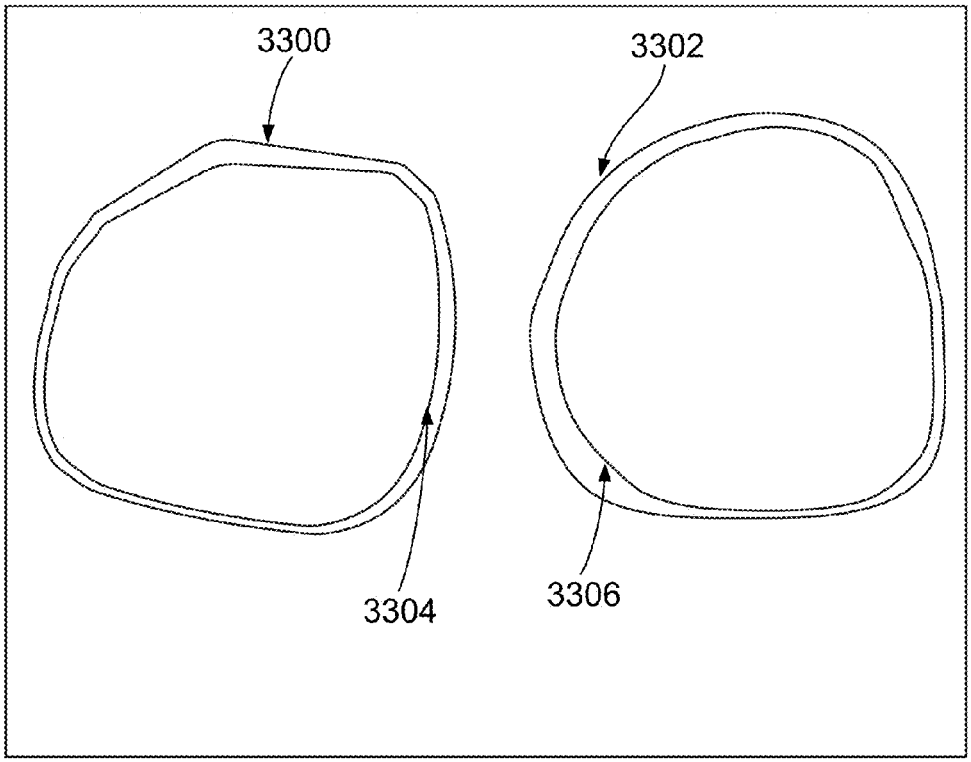
FIG. 33 is a combined view of the cross-sections of the model shown in FIG. 30 at the planes $z_1$ and $z_2$ shown in FIG. 32.

FIG. 32 is a side view of the surface model 3000 and the neighboring planes $z_1$ and $z_2$ that are separated by the reduced incremental depth $\Delta z$. FIG. 33 is a combined view of the cross-sections of the model 3000 at the planes $z_1$ and $z_2$ shown in FIG. 32. As shown in FIG. 33, the equalization module 2900 determines that there are two curves 3300, 3302 defined by the intersection of the model 3000 and the plane $z_1$ and also two curves 3304, 3306 defined by the intersection of the model 3000 and the plane $z_2$. Because the number of curves in each of the planes $z_1$ and $z_2$ are equal, the equalization module 2900 may establish the value of the incremental depth $\Delta z$ to be this smaller distance between the planes $z_1$ and $z_2$ shown in FIG. 32.

If the number of curves in the planes $z_1$ and $z_2$ still differ from each other, the equalization module 2900 may further reduce the incremental depth $\Delta z$ and compare the number of curves in the planes $z_1$ and $z_2$. The equalization module 2900 may continue to reduce the incremental depth $\Delta z$ until the number of curves in the planes $z_1$ and $z_2$ are equal or until a limit on the incremental depth $\Delta z$, such as an operator- or system-defined (e.g., default) incremental depth $\Delta z_c$ is reached. If the numbers of curves in the neighboring planes $z_1$ and $z_2$ are still not equivalent, then the equalization module 2900 may change the location of at least one of the planes (e.g., the upper plane $z_1$), such as by shifting the plane up along the Z direction 122 by one fourth of the incremental depth $\Delta z$ (or another amount). The other plane (e.g., the lower plane $z_2$) alternatively or also may be moved, such as by the incremental depth $\Delta z$ along the Z direction 122. Alternatively, the lower plane $z_2$) may be moved in the opposite direction as the upper plane $z_1$. The equalization module 2900 may continue to iteratively change the incremental depth $\Delta z$ and/or the locations of the planes $z_1$ and $z_2$ until the number of curves in the planes $z_1$ and $z_2$ is equivalent or until a limit on the number of iterations, the locations of the planes $z_1$ and $z_2$, or another limit is reached. The equalization module 2900 can repeat this process for all or at least a designated fraction of the size of the model 3000.

With continued reference to the model 3000 in FIG. 30 and returning to the discussion of the control unit 2900 shown in FIG. 29, a sorting module 2912 sorts the curves that are identified by the equalization module 2900. The sorting module 2912 can sort the curves so that the curves that are part of the same feature of the model are associated with each other. A feature of a model can include a three-dimensional subset or portion of the model. For example, the model 3000 includes two features 3002, 3004 that are bumps in the model 3000. Once the equalization module 2910 identifies the curves 3300, 3302, 3304, 3306 that are formed by the features 3002, 3004 (e.g., as described above), the sorting module 2912 can determine which curves belong to which features. With respect to the model 3000, the sorting module 2912 determines that the curves 3300, 3304 are associated with (e.g., formed by) the feature 3002 and the curves 3302, 3306 are associated with the feature 3004.

In one embodiment, the sorting module 2912 associates the curves with the features based on two-dimensional areas enclosed the curves and distances between curves in different planes (e.g., planes $z_1$ and $z_2$). The sorting module 2912 can calculate the areas enclosed by each curve and determine the locations of centroids (or other locations) of the curves. The curves that are in different planes, have similar areas, and that are separated by relatively small distances between the respective centroids of the curves (also referred to as centroidal distances) can be associated with the same feature of the model. As one example, the sorting module 2912 can sort the curves within each plane according to the sizes of the areas encompassed by the curves (e.g., from largest to smallest area). The curves within different planes (e.g., planes $z_1$ and $z_2$) can then be sorted according to distances between the centroids of the curves in the different planes (e.g., smallest to largest distances, or largest to smallest distances). The curves having the smallest centroidal distances (and similar sizes) in the different planes $z_1$ and $z_2$ may be associated with each other (e.g., as belonging to the same feature in the model). Alternatively, curves in different planes that have areas that differ from each other by less than a threshold amount and/or centroidal distances that are smaller than a threshold amount may be associated with the same feature.

A classification module 2914 receives the sorted curves from the sorting module 2912 and classifies the curves based on the relative locations of the curves. For example, the classification module 2914 can identify which of the curves are located within other curves (e.g., internal curves) and to find out which curve is outside of the internal curves (e.g., an external, or "parent," curve). An internal curve may be a curve that is disposed entirely within another curve. A parent number can be determined for each internal curve. The parent number represents the number of external curves for an internal curve (e.g., the number of curves in which the internal curve is located entirely within).

Figures 34, 35:
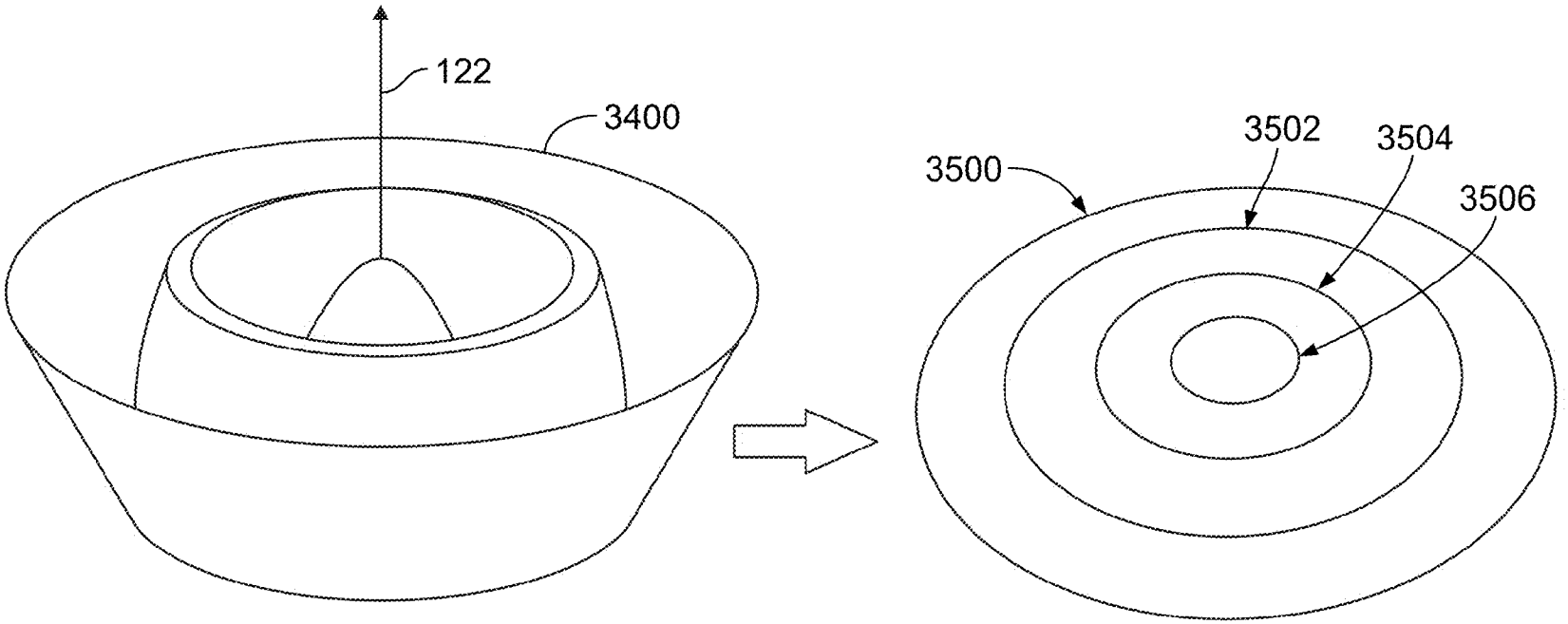
FIG. 34 is a perspective view of another example of a model that may be formed by the control unit shown in FIG. 29.
FIG. 35 is a view of curves of the model shown in FIG. 34 that are identified by the control unit shown in FIG. 29.

FIG. 34 is a perspective view of another example of a model 3400 that may be formed by the control unit 2900. The model 3400 is provided merely as an example and other models may be used. FIG. 35 is a view of curves 3500, 3502, 3504, 3506 of the model 3400 that are identified by the control unit 2900. The curves 3500, 3502, 3504, 3506 may be defined by an intersection of the model 3400 with a plane having the Z direction 122 as the normal to the plane. The classification module 2914 may identify the curves 3502, 3504, 3506 as internal curves and the curves 3500, 3502, 3504, 3506. For example, the curve 3506 is internal to all other curves 3500, 3502, 3504, the curve 3500 is external to all other curves 3502, 3504, 3506, and the curves 3502 and 3504 are internal to some curves and external to other curves. The classification module 2914 also can determine the curve 3500 to have a parent number of zero, the curve 3502 to have a parent number of one, the curve 3504 to have a parent number of two, and the curve 3506 to have a parent number of three. The parent numbers of the curves 3500, 3502, 3504, 3506 can be used to determine a starting location for toolpaths used to form each feature in the model 3400. For example, the parent numbers of the curves can be used to determine the order in which the different curves of the model are to be formed by the control unit 2900.

Returning to the discussion of the control unit 2900 shown in FIG. 29, a point generation module 2916 receives the order in which the curves of the model are to be processed and the groups of curves (e.g., with each group of curves representing the curves of the same feature). The point generation module 2916 generates helixes and toolpath points for the features. The helixes represent the curvature of the model (e.g., the model 3000) in the spaces between the curves in the neighboring planes throughout all or substantially all of the model. The helixes may be identified by determining the three dimensional paths between curves in one plane (e.g., plane $z_1$) with the same curves (e.g., curves that are approximately the same size) in the neighboring plane (e.g., plane $z_2$). The toolpath points represent the locations in the sheet (that is to be formed according to the model) where the tools of the system engage the sheet to deform the sheet into the component defined by the model.

In one embodiment, the point generation module 2916 determines the helixes by obtaining pairs of curves from neighboring planes of the model. For example, the point generation module 2916 may obtain the curves 3300 and 3304 from planes $z_1$ and $z_2$, respectively, for the feature 3002 of the model 3000. The point generation module 2916 can obtain the curves 3302 and 3306 from planes $z_1$ and $z_2$, respectively, for the feature 3002 of the model 3000. The point generation module 2916 then identifies the segment of the model 3000 that extends between the curves. For example, the point generation module 2916 can identify the three dimensional contour defined by the model 3000 from the curve 3300 to the curve 3304 (or from the curve 3304 to the curve 3300) and the three dimensional contour defined by the model 3000 from the curve 3302 to the curve 3306 (or from the curve 3306 to the curve 3302). Additional segments can be identified between other planes and curves. The segments can be referred to as shapes or trimmed shapes of the model 3000.

Figure 36:
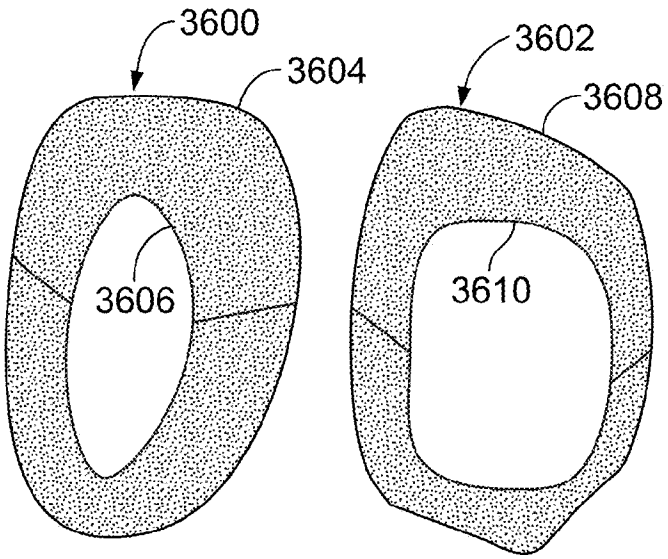
FIG. 36 is a top view of one example of segments of the model shown in FIG. 30.

FIG. 36 is a top view of one example of segments 3600, 3602 of the model 3000. The segments 3600, 3602 extend between corresponding pairs of curves 3604, 3606, 3608, 3610. For example, the segment 3600 extends from the curve 3604 (which may be in a plane $z_3$ of the model 3000) to the curve 3606 (which may be in a plane $z_4$ of the model 3000) and the segment 3602 extends from the curve 3608 in the plane $z_3$ to the curve 3610 in the plane $z_4$). The curves 3604, 3606, 3608, 3610 may be identified and associated with each other as described above.

With continued reference to the segments 3600, 3602 in FIG. 36 and returning to the discussion of the point generation module 2916 in FIG. 29, the module 2916 can generate a helicoid having a center at a centroid of one of the curves in one of the planes and a relatively large radius. For example, in order to determine the helix between the curves 3604, 3606, the point generation module 2916 can determine a helicoid having a center at the centroid of the curve 3604 or 3606 and having a radius that is larger than a size (e.g., a largest dimension) of the model 3000 or the component to be formed by the control unit 2900 from the model 3000. The pitch of the helicoid can be represented by the following:

$$P = \frac{\|z_i - z_j\|}{N} \quad \text{(Eqn. 18)}$$

where P represents the pitch of the helicoid, $\|z_i - z_j\|$ represents the distance between the planes $z_i$ and $z_j$ (such as the planes $z_3$ and $z_4$ along the Z direction 122), and N represents the number of turns of the helicoid. The number of turns N may be based on a difference in the areas of the curves (between which the helix being created extends). For example, if the difference in areas of the curves 3300 and 3304 is greater than an operator- or system-designated limit (e.g., $\text{area}_c$), then the number of turns N may be:

$$N = \frac{\|A_{zi} - A_{zj}\|}{\text{area}_c} \quad \text{(Eqn. 19)}$$

where $A_{zi}$ represents the area of one of the curves (e.g., curve 3604) in one of the planes (e.g., plane $z_3$) and $A_{zj}$ represents the area of the other curve (e.g., curve 3606) in the other plane (e.g., plane $z_4$). The non-integer values of the number of turns N can be rounded (e.g., up) to the next integer value. The area constraint here represents a surface finish constraint, which can be used as an additional constraint to generate a toolpath.

The point generation module 2916 can intersect the helicoid with each of the segments (e.g., shapes or trimmed shapes) of the model 3000 for the pair of planes. This intersection provides helical curves that represent piecewise helixes for one pair of the planes (e.g., the planes $z_3$ and $z_4$). The point generation module 2916 can repeat the above process for the other pairs of neighboring planes z in the model 3000.

Figure 37:
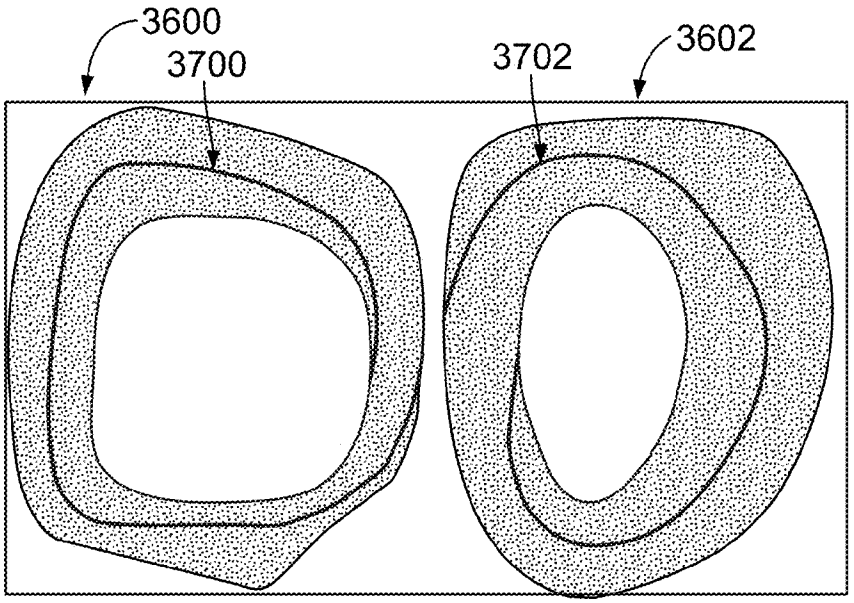
FIG. 37 is a top view of an example of helical curves formed by the intersection of the segments shown in FIG. 36 of the model shown in FIG. 30 with helicoids.

FIG. 37 is a top view of an example of helical curves 3700, 3702 formed by the intersection of the segments 3600, 3602 of the model 3000 with helicoids. The point generation module 2916 can identify the helical curves 3700, 3702 as described above.

The helical curves 3700, 3702 can be used to create the toolpaths of the tools 104, 108 of the systems 100, 2300. A starting location for the tools may be stablished by the point generation module 2916 along each of the helical curves 3700, 3702. In one embodiment, the starting location on a helical curve 3700, 3702 is at a point along the helical curve 3700, 3702 that is farthest along the positive Z direction 122. Alternatively, the starting location on a helical curve 3700, 3702 is at a point along the helical curve 3700, 3702 that is farthest along the negative Z direction 122. In another embodiment, another location may be selected. Additional contact points along the helical curves 3700, 3702 are then generated. The contact points can represent the locations where the tools engage and deform the sheet. In one embodiment, the contact points may be stablished at regular intervals of the operator-supplied or system-default distance Δc.

The point generation module 2916 can determine which of the tools 104 or 108 is the supporting tool and which of the tools 108 or 104 is the forming tool at the different contact points along the helical curves 3700, 3702. This determination may be made based on whether the feature being formed by deforming the sheet at the contact point is above or below the sheet along the Z direction 122 (e.g., along the positive Z direction 122 or the negative Z direction 122). Additionally or alternatively, this determination may be made based on whether the feature is an external or internal feature. For example, the determination of which tool 104 or 108 is the supporting tool and which is the forming tool at a contact point may additionally or alternatively be based on whether one or more other features are located outside of the feature being formed by deformation at the contact point. Four potential arrangements of the tools 104, 108 and features to be formed may dictate which tool 104, 108 is the supporting tool and which is the forming tool in one embodiment.

Figure 38:
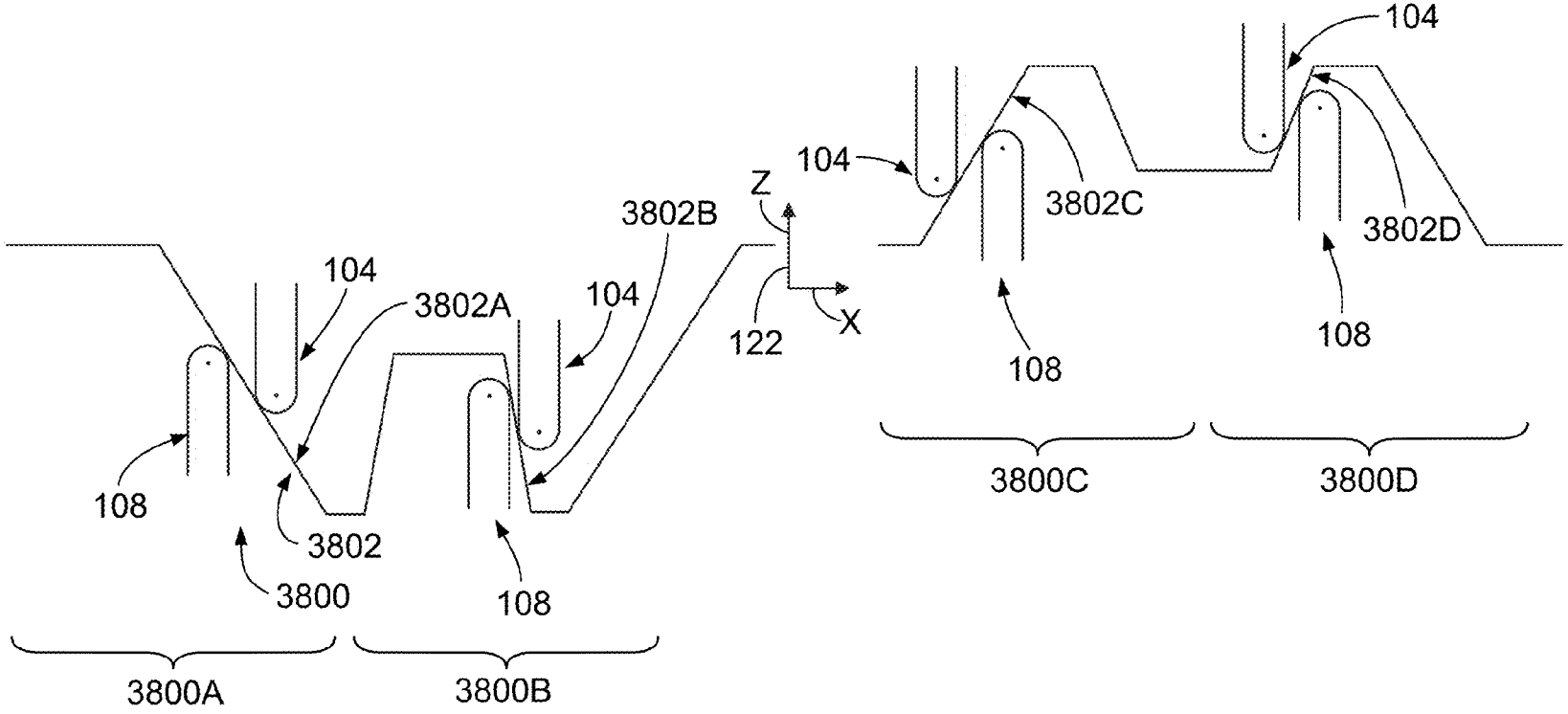
FIG. 38 illustrates different arrangements of the tools shown in FIG. 1 for forming different features in accordance with one example.

FIG. 38 illustrates different arrangements 3800 (e.g., 3800A-D) of the tools 104, 108 for forming different features 3802 (e.g., 3802A-D) in accordance with one example. The arrangements 3800 are used by the point generation module 2916 to determine which tool 104, 108 is the supporting tool and which is the forming tool in forming the corresponding feature 3802. The point generation module 2916 can determine which features are internal or external features based on the parent numbers associated with the curves from which the contact point is associated. For example, the features 3802A and 3802D may have parent numbers of zero or an even number, which indicates that the features 3802A, 3802D are external features. The features 3802B and 3802C may have odd parent numbers, which indicates that the features 3802B, 3802C are internal features.

In the arrangement 3800A, the feature 3802A is an external feature and the feature 3802A extends below the sheet, or in the negative Z direction 122. Because the feature 3802A is an external feature that extends in the negative Z direction 122, the point generation module 2916 may designate the tool 104 as the forming tool and the tool 108 as the supporting tool. As a result, during forming of the sheet at this contact point, the tool 104 may move relative to the tool 108 (e.g., downward in the view of FIG. 38) while the tool 108 remains stationary.

In the arrangement 3800B, the feature 3802B is an internal feature and the feature 3802B extends below the sheet, or in the negative Z direction 122. Because the feature 3802B is an internal feature that extends in the negative Z direction 122, the point generation module 2916 may designate the tool 104 as the supporting tool and the tool 108 as the forming tool. As a result, during forming of the sheet at this contact point, the tool 108 may move relative to the tool 104 (e.g., upward in the view of FIG. 38) while the tool 104 remains stationary.

In the arrangement 3800C, the feature 3802C is an external feature and the feature 3802C extends above the sheet, or in the positive Z direction 122. Because the feature 3802C is an external feature that extends in the positive Z direction 122, the point generation module 2916 may designate the tool 104 as the supporting tool and the tool 108 as the forming tool. As a result, during forming of the sheet at this contact point, the tool 108 may move relative to the tool 104 (e.g., upward in the view of FIG. 38) while the tool 104 remains stationary.

In the arrangement 3800D, the feature 3802D is an internal feature and the feature 3802D extends above the sheet, or in the positive Z direction 122. Because the feature 3802D is an internal feature that extends in the positive Z direction 122, the point generation module 2916 may designate the tool 104 as the forming tool and the tool 108 as the supporting tool. As a result, during forming of the sheet at this contact point, the tool 104 may move relative to the tool 108 (e.g., downward in the view of FIG. 38) while the tool 108 remains stationary.

The contact point locations, toolpaths, and/or designations of which tools are the forming versus supporting tools is communicated to a path writing module 2918 of the control unit 2900. The path writing module 2918 determines which directions the tools 104, 108 move relative to the sheet to form the component from the sheet. The path writing module 2918 directs the forming tool to move in the direction in which the feature being formed is to protrude from the sheet. For example, if the feature protrudes in a positive Z-direction and the lower tool 108 is the forming tool, then the path writing module 2918 can direct the lower tool 108 to move in a positive Z direction 122. If the feature protrudes in a positive Z-direction and the upper tool 104 is the forming tool, then the path writing module 2918 can direct the upper tool 104 to move in a negative Z direction 122. If the feature protrudes in a negative Z-direction and the lower tool 108 is the forming tool, then the path writing module 2918 can direct the lower tool 108 to move in a positive Z direction 122. If the feature protrudes in a negative Z-direction and the upper tool 104 is the forming tool, then the path writing module 2918 can direct the upper tool 104 to move in a negative Z direction 122.

A single helical toolpath (e.g., a generally spiral shaped toolpath) may be used for both of the tools 104, 108 to form a three dimensional feature from a sheet. For example, a single helical curve (e.g., curve 3700 or 3702) may be formed as a toolpath for each protrusion that extends from one side of the sheet. Alternatively or additionally, a single toolpath may be generated for the entire component that is to be formed from the sheet (where the component includes several features, or protrusions, from the initial planar dimensions of the sheet). The tools 104, 108 may travel along the single toolpath and deform the sheet as described herein. By following the toolpath and moving in an in-to-out direction (e.g., from the center of the sheet toward the exterior boundaries of the sheet), the tools 104, 108 may avoid deforming a previously formed feature or when deforming the sheet to form another, separate and/or different feature. The designation of which tool 104 or 108 is the forming tool and which is the supporting tool can switch between the tools 104, 108 as the tools 104, 108 move along the toolpath without the sheet being removed from between the tools 104, 108 (e.g., such as by flipping the sheet over). This designation of the tools 104, 108 can switch so that protruding features (e.g., curves) can be formed so as to extend from both side of the sheet as the tools 104, 108 move along the single toolpath a single time.

The contact point locations, toolpaths, directions of movement of the tools, and the like, are communicated as an output signal 2920 from the path writing module 2918 to the motors that control movement of the tools 104, 108. Alternatively, the output signal 2920 may be communicated to another processing device that controls the motors to move the tools 104, 108 to form the component from a sheet.

Figure 39:
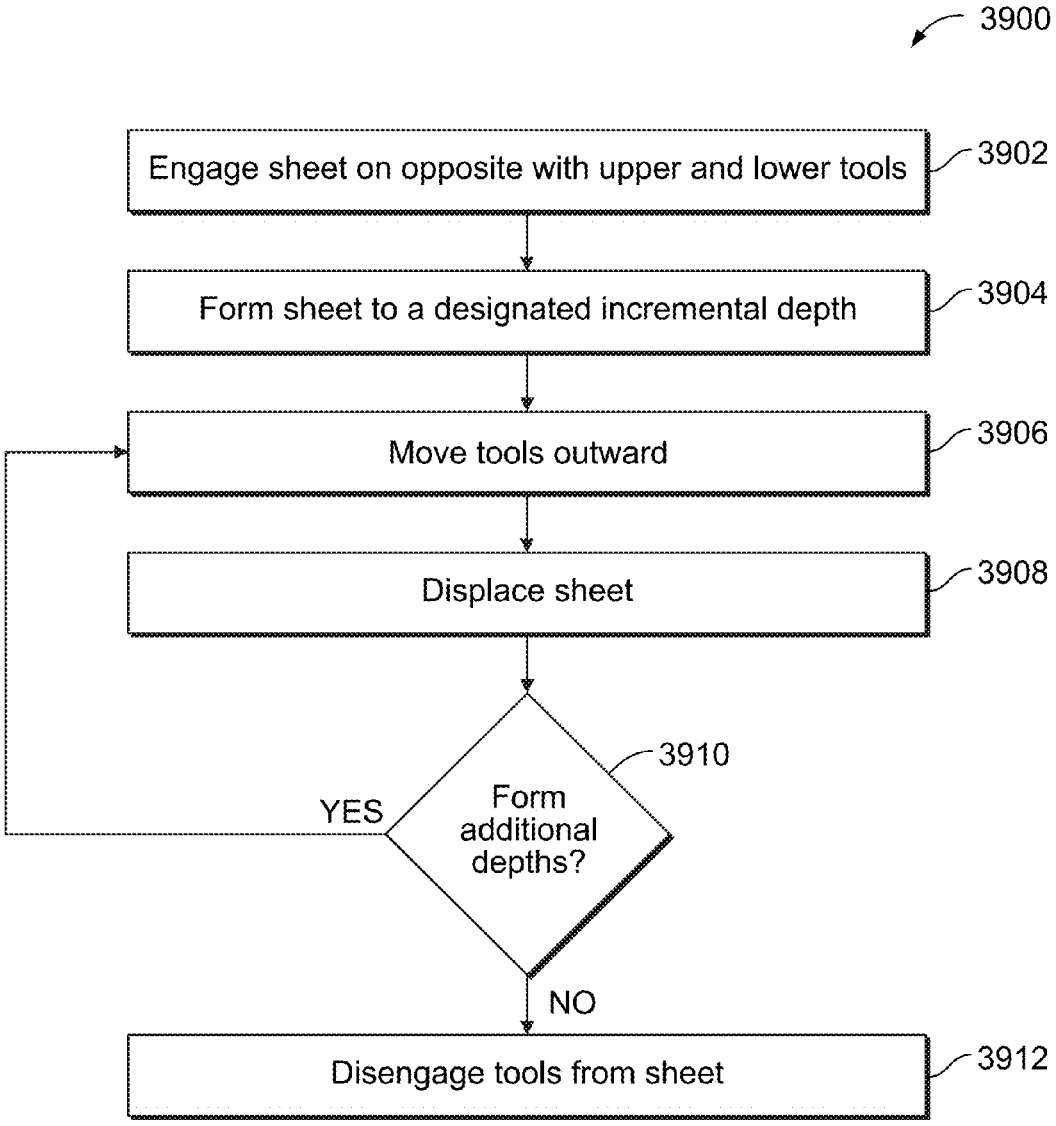
FIG. 39 is a flowchart of one embodiment of a method for accumulative double sided incremental forming (ADSIF).

FIG. 39 is a flowchart of one embodiment of a method 3900 for accumulative double sided incremental forming (ADSIF). The method 3900 may be used in conjunction with one or more embodiments of the system 100 (shown in FIG. 1) and/or 2300 (shown in FIG. 12) described above. At 3902, a sheet (e.g., a metal sheet) is engaged on both sides by tools, such as the tools 104, 108. The tools 104, 108 may engage the sheet 302 at a location away from the outer edges of the component to be formed by the sheet 302. For example, the tools 104, 108 may engage the sheet at or near a center of the part of the metal sheet 302 that corresponds to the center of the component to be formed by the metal sheet 302. Alternatively, the tools 104, 108 may engage the sheet at or near another part of the metal sheet 302 that corresponds to a location of the component to be formed by the metal sheet 302 that is closer to the center of the component than an outer edge of the component.

At 3904, the sheet is formed to a designated incremental depth. For example, the tools 104, 108 may be displaced in a direction that is angled (e.g., perpendicular) to the plane defined by the metal sheet 302 by a designated distance. As the tools 104, 108 move, a portion of the sheet is deformed.

At 3906, the tools 104, 108 are moved outward, such as by laterally moving the tools 104, 108 toward one or more of the outer edges of the metal sheet 302. At 3908, another portion of the sheet is deformed. For example, as the tools 104, 108 laterally move, additional portions of the sheet 302 may be deformed. Alternatively or additionally, the tools 104, 108 also may move in the direction that is angled with respect to the plane of the sheet 302.

At 3910, a determination is made as to whether additional portions of the sheet are to be deformed by the tools 104, 108. For example, if additional deformation of the sheet 302 is needed to form the component, then flow of the method 3900 returns to 3906 where the tools 104, 108 can be moved laterally outward and/or displaced in a direction that is angled (e.g., perpendicular) to the plane defined by the metal sheet 302 by a designated distance. The distances that the tools 104, 108 are displaced in each instance may be the same. In another embodiment, the distances that the tools 104, 108 are displaced in each instance may be different.

At 3912, the tools 104, 108 are disengaged from the sheet. For example, once the tools 104, 108 are finished forming the component or a portion of the component. The tools 104, 108 are released from the sheet 302 so that the component (e.g., the deformed sheet) can be removed from the system 100.

Figure 41:
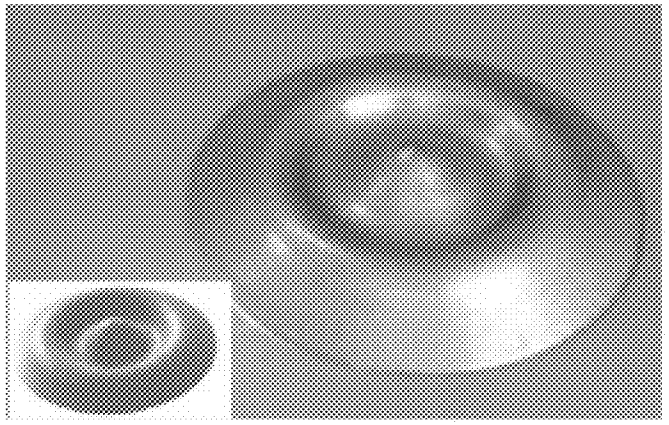
FIG. 41 is a perspective view of another example of a component formed using the ADSIF described herein and a model that is followed by the system shown in FIG. 1 and/or the system shown in FIG. 12 in forming the component.
Figure 40:
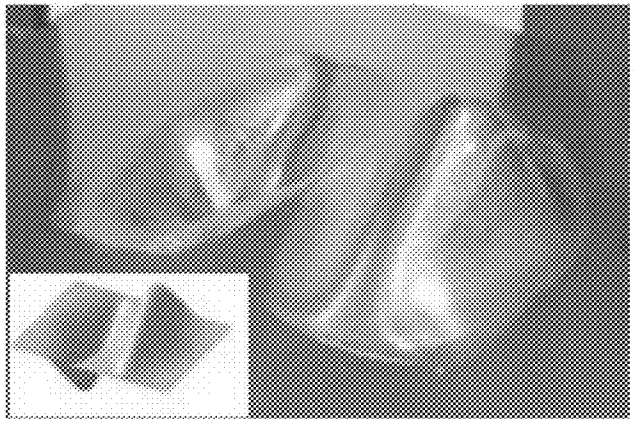
FIG. 40 is a perspective view of one example of a freeform component formed using the ADSIF described herein and a model 802 that is followed by the system shown in FIG. 1 and/or the system shown in FIG. 12 in forming the component.

FIG. 40 is a perspective view of one example of a freeform component 800 formed using the ADSIF described herein and a model 802 that is followed by the system 100 shown in FIG. 1 and/or the system 2300 shown in FIG. 12 in forming the component 800. FIG. 41 is a perspective view of another example of a component 900 formed using the ADSIF described herein and a model 902 that is followed by the system 100 shown in FIG. 1 and/or the system 2300 shown in FIG. 12 in forming the component 900.

The freeform component 800 includes features above and below a neutral plane of the blank (e.g., the metal sheet) and the component 900 includes concavo-convex features. The components 800, 900 were formed without flipping the sheet or without a change in the tooling. These components 800, 900 were formed without any manual component-specific process planning.

Figures 42, 43:
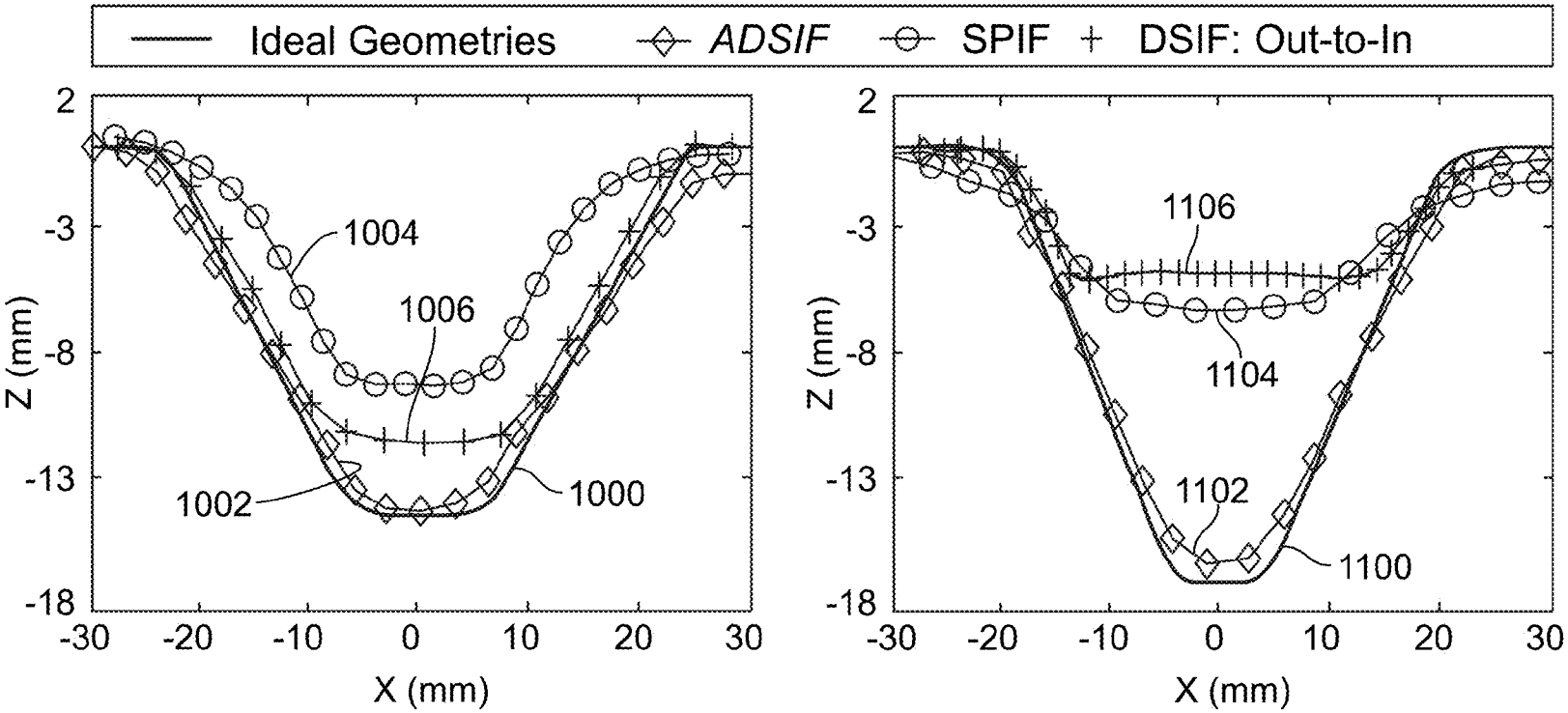
FIG. 42 provides a comparison of the geometries of cones formed using one embodiment of ADSIF, SPIF, and DSIF.
FIG. 43 provides another comparison of the geometries of cones formed using one embodiment of ADSIF, SPIF, and DSIF.

FIG. 42 provides a comparison of the geometries of cones formed using one embodiment of ADSIF, SPIF, and DSIF. FIG. 43 provides another comparison of the geometries of cones formed using one embodiment of ADSIF, SPIF, and DSIF. The cones associated with FIG. 42 have wall angles of 40° while the cones associated with FIG. 43 have wall angles of 50°. The cones were formed on AA2024 sheets of thickness 0.5 mm with $\Delta z$=0.025 mm. This material was selected due to its wide adoption in automotive industry. The surface of the formed components was scanned using a laser scanner with a resolution of ±0.22 mm in the X, ±0.16 mm in the Y and ±0.10 mm in the Z directions. The same components were also formed using SPIF following a spiral out-to-in toolpath and using DSIF following the out-to-in "squeezing toolpath" described above with $\Delta z$=0.025 mm.

The formed geometries of these components, measured after removing the tools and unclamping the sheet, were compared to ideal (e.g., designated) geometries of the cones. A data line 1000, 1100 in each of FIGS. 42 and 43 represents the designated geometries, a data line 1002, 1102 in each of FIGS. 42 and 43 represents the measured geometries of the cones formed using ADSIF, a data line 1004, 1104 in each of FIGS. 42 and 43 represents the measured geometries of the cones formed using SPIF, and a data line 1006, 1106 in each of FIGS. 42 and 43 represents the measured geometries of the cones formed using SPIF and DSIF, as described above.

As compared to SPIF and out-to-in DSIF, a remarkably accurate geometry was obtained with ADSIF, with a maximum shape deviation of 1.15 mm. Visual observation confirmed the presence of continuous tool marks on either side of the sheet, indicating little to no loss of contact between both tools and the sheet in ADSIF. Furthermore, the 50° cone fractured when formed with SPIF and the out-to-in DSIF toolpaths, but not in ADSIF. Therefore, formability is better in ADSIF.

Figure 44:
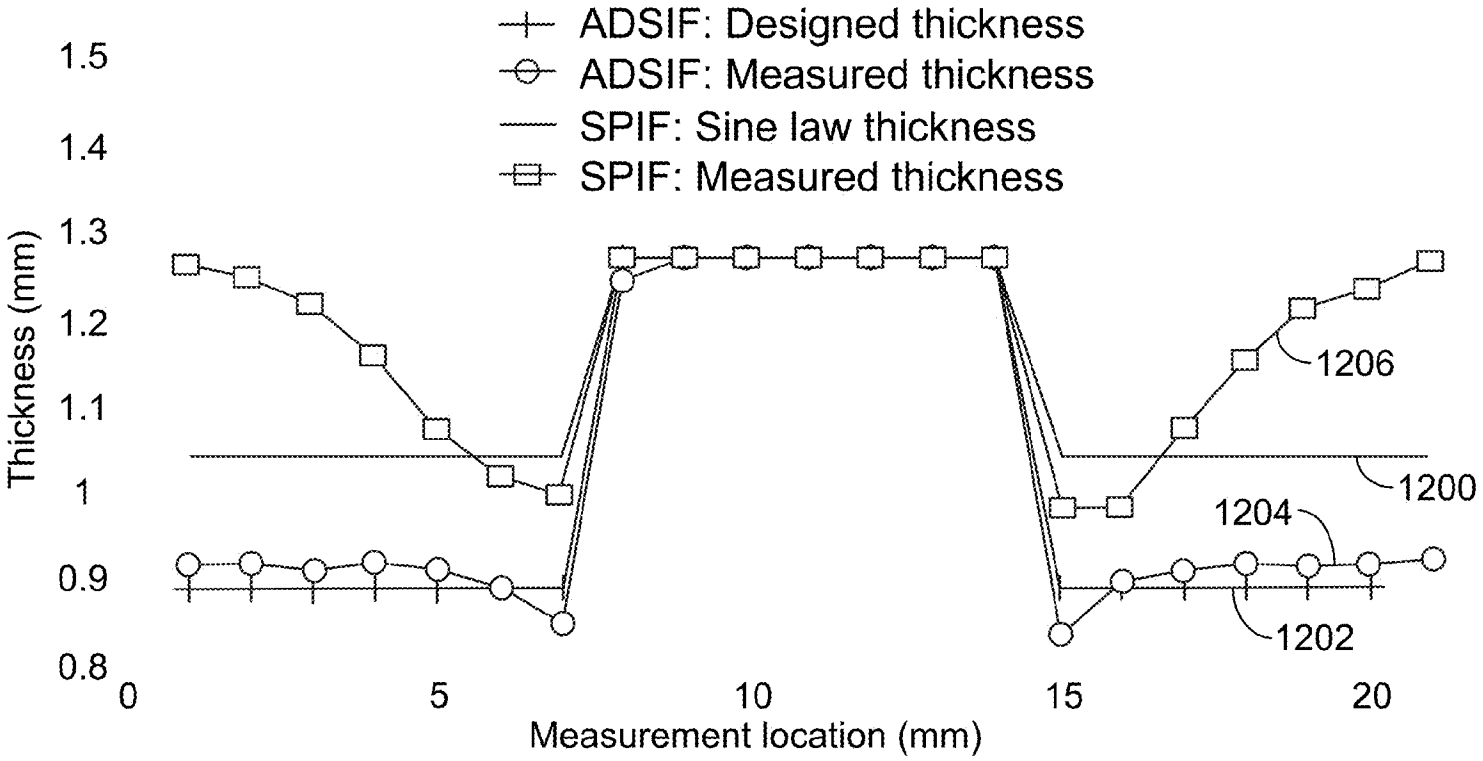
FIG. 44 illustrates thicknesses of cone components formed using ADSIF or SPIF in accordance with one example.

FIG. 44 illustrates thicknesses of cone components formed using ADSIF or SPIF in accordance with one example. The cones have wall angles of 35° and were formed from a 1.27 mm thick AA5052 sheet, to a depth of 15 mm with s=0.85 and $\Delta z$=0.05 mm. The component was cut at a central cross section and the deformed wall thickness was measured using a micrometer. A data line 1200 represents the thickness of the cone determined according to the sine law. A data line 1202 represents the designated thickness of the cone for ADSIF. A data line 1204 represents the measured thickness of the cone formed using ADSIF. A data line 1206 represents the measured thickness of the cone formed using SPIF. Based on Equation 2 described above, the deformed wall thickness of the cone formed from ADSIF should be 0.88 mm and from the sine law it should be 1.04 mm in SPIF. The data lines in FIG. 44 show that the deformed thickness of the wall in ADSIF was nearly constant and compared very closely to the designed thickness, while SPIF exhibited a continuous thinning.

Figure 45:
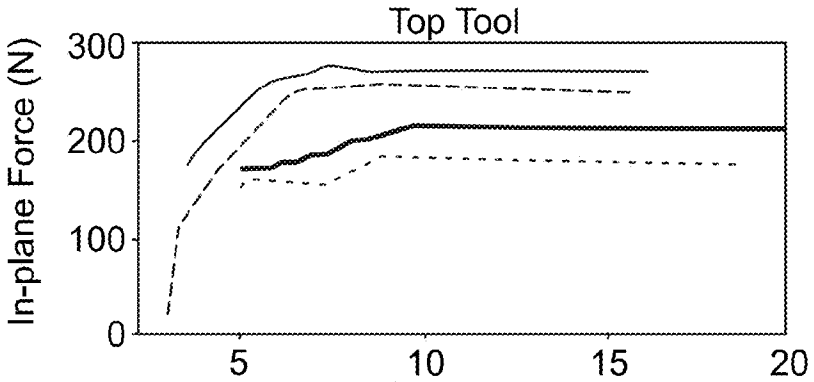
FIG. 45 illustrates Z forces and in-plane forces for the upper tool shown in FIG. 1 in forming cones having wall angles of 40° using one embodiment of ADSIF.
Figure 46:
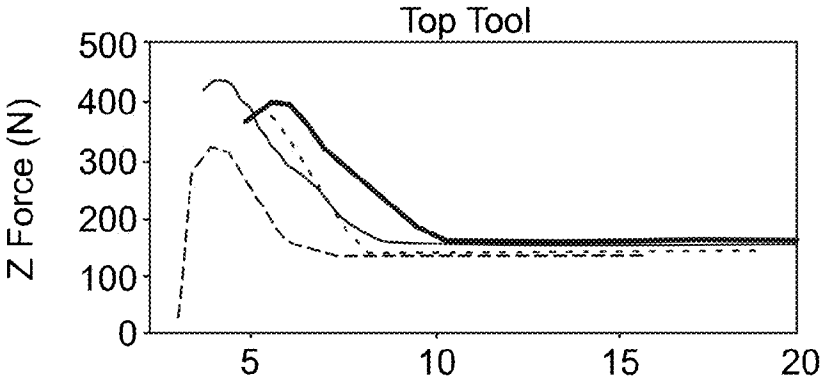
FIG. 46 illustrates Z forces and in-plane forces for the upper tool shown in FIG. 1 in forming cones having wall angles of 50° using one embodiment of ADSIF.
Figure 47:
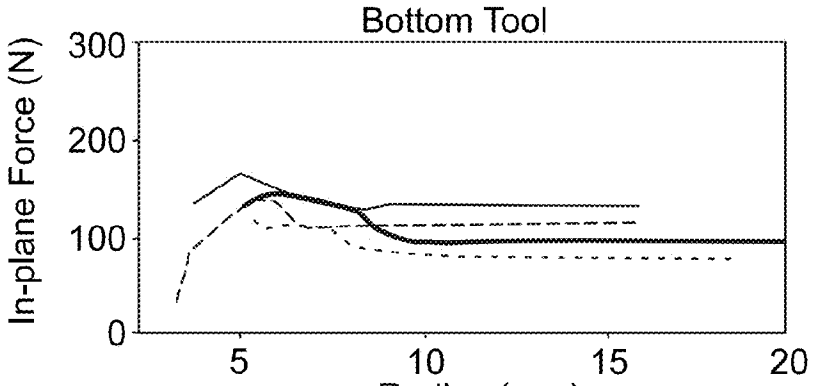
FIG. 47 illustrates Z forces and in-plane forces for the lower tool shown in FIG. 1 in forming cones having wall angles of 40° using one embodiment of ADSIF.
Figure 48:
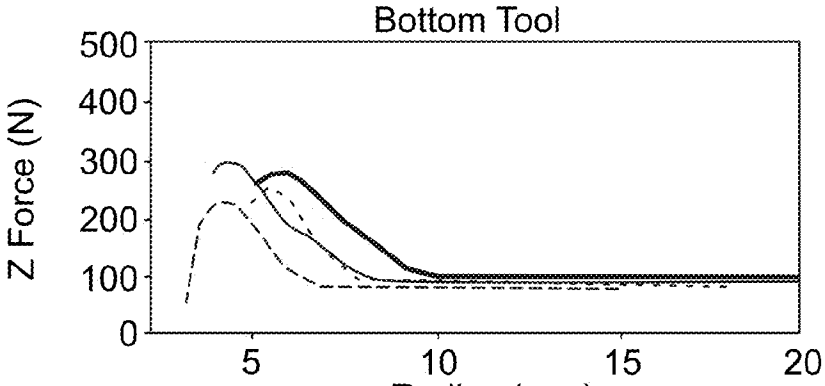
FIG. 48 illustrates Z forces and in-plane forces for the lower tool shown in FIG. 1 in forming cones having wall angles of 50° using one embodiment of ADSIF.
Figures 49, 50:
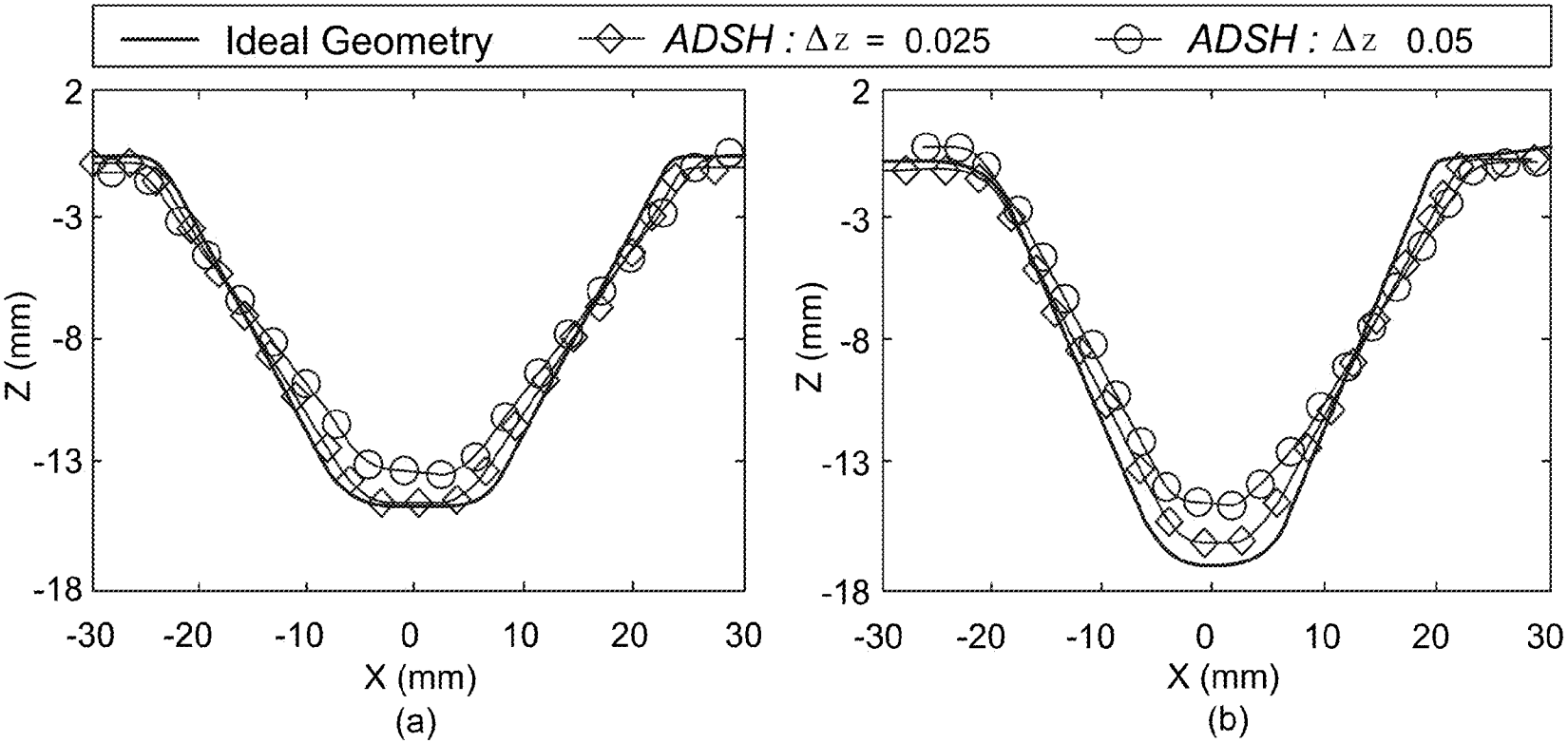
FIG. 49 illustrates different geometries of a cone having a wall angle of 40° in accordance with one example.
FIG. 50 illustrates different geometries of a cone having a wall angle of 50° in accordance with one example.

FIGS. 45 and 46 illustrate Z forces and in-plane forces (e.g., the resultant of the forces along the X and Y directions) for the upper tool 104 in forming cones having wall angles of 40° and 50°, respectively, and that were formed using ADSIF with $\Delta z$=0.025 mm and $\Delta z$=0.05 mm, respectively, in accordance with one example. FIGS. 47 and 48 illustrate Z forces and in-plane forces (e.g., the resultant of the forces along the X and Y directions) for the lower tool 108 in forming cones having wall angles of 40° and 50°, respectively, and that were formed using ADSIF with $\Delta z$=0.025 mm and $\Delta z$=0.05 mm, respectively, in accordance with one example. FIG. 49 illustrates the ideal geometry, the actual ADSIF geometry (with $\Delta z$=0.025 mm), and the actual ADSIF geometry (with $\Delta z$=0.05 mm) of the cone having a wall angle of 40°. FIG. 50 illustrates the ideal geometry, the actual ADSIF geometry (with $\Delta z$=0.025 mm), and the actual ADSIF geometry (with $\Delta z$=0.05 mm) of the cone having a wall angle of 50°.

Note that the ideal geometries of both cones have a fillet on the base. During the forming of this flatter region, the Z forces are quite high. As the wall angle being formed increases the tools start squeezing the material in the X-Y direction. Therefore, the Z force reduces and the dominant forces on the tool are the X-Y forces. Therefore while the tool stiffness in the Z direction is important, the tool stiffness in the X-Y direction becomes even more important when using ADSIF. FIGS. 45-48 also show that an increase in $\Delta z$ (from $\Delta z$=0.025 mm to $\Delta z$=0.050 mm) causes an increase in the forces, primarily the in-plane forces but not so much the Z forces. Hence, the tool deflection is greater at a larger $\Delta z$, causing more errors in the formed geometry, as shown in FIGS. 49 and 50.

A study of the forming forces in ADSIF shows that the inplane forces are very significant as compared to the Z forces. Transforming the dominant forces from the vertical direction to the plane of the sheet ensures that bending of the sheet in the Z direction is minimized or at least reduced. At the same time, small incremental depths have to be used to prevent significant geometric inaccuracies caused by tool deflection owing to in-plane forces. This issue will get intensified when thicker sheets with higher yield strengths are to be formed. In one embodiment, these inaccuracies may be avoided or reduced by increasing the tool stiffness and/or using localized heating of the metal sheet to further reduce forming forces through hybrid processes.

In one embodiment, a system (e.g., a forming system) includes first and second tools, one or more moving assemblies, and a control unit. The first tool is configured to be disposed on a first side of a deformable sheet and the second tool is configured to be disposed on an opposite, second side of the sheet. The moving assemblies are configured to move the first tool and the second tool relative to the sheet. The control unit is configured to control movement of the first tool and the second tool by the one or more moving assemblies by moving at least one of the first tool or the second tool in a first deformation direction to deform the sheet, then moving the first and second tools laterally relative to the sheet to a subsequent location while engaging the sheet, then moving at least one of the first tool or the second tool in the first deformation direction or an opposite second deformation direction to deform the sheet, and then continue moving the first and second tools to deform the sheet in order to create a three-dimensional component from the sheet.

In another aspect, one of the first tool or the second tool is a forming tool and the other of the first tool or the second tool is a supporting tool. The control unit is configured to move the forming tool in the deformation direction relative to the supporting tool to deform the sheet.

In another aspect, the control unit is configured to switch which of the first or second tools is the forming tool and which is the supporting tool in order to change which direction the sheet is deformed.

In another aspect, the three-dimensional component includes plural three-dimensional features that protrude from one or more of the sides of the sheet. The control unit is configured to determine which of the first tool or the second tool is the forming tool and which is the supporting tool for forming at least a first feature of the features based on whether the first feature is an internal feature having one or more other features disposed laterally outside of the first feature and based on which of the sides of the sheet that the first feature protrudes from.

In another aspect, the control unit is configured to at least one of receive or generate a single toolpath along the sheet for the first and second tools to follow to form the three-dimensional component from the sheet.

In another aspect, the toolpath is a helical toolpath.

In another aspect, the control unit is configured to generate the toolpath such that the first and second tools avoid further deformation of a previously formed protruding feature of the three-dimensional component when later deforming the sheet to form a subsequently formed protruding feature.

In another aspect, the control unit is configured to direct the first and second tools to deform the sheet by causing the first and second tools to laterally move outward relative to the sheet from a center location of the sheet after the at least one of the first tool or the second tool is moved in the first deformation direction.

In another aspect, the control unit is configured to move the first and second tools to create the three-dimensional component that includes protruding features that extend from both sides of the sheet.

In one embodiment, a method (e.g., for forming a deformable sheet) includes engaging a first tool with a first side of the deformable sheet and a second tool with an opposite, second side of the sheet, moving at least one of the first tool or the second tool in a first deformation direction to deform the sheet, laterally moving the first and second tools relative to the sheet to a subsequent location while engaging the sheet, moving at least one of the first tool or the second tool in the first deformation direction or an opposite second deformation direction to deform the sheet, and continuing to move the first and second tools in at least one of the first deformation direction, the second deformation direction, or laterally relative to the sheet in order to create a three-dimensional component from the sheet.

In another aspect, the first tool or the second tool that moves in the first deformation direction or the second deformation direction is a forming tool and the other tool is the supporting tool, further wherein the forming tool moves relative to the supporting tool.

In another aspect, the method also includes switching which of the first or second tools is the forming tool and which is the supporting tool in order to change which direction the sheet is deformed.

In another aspect, the three-dimensional component includes plural three-dimensional features that protrude from one or more of the sides of the sheet. Switching which of the first tool or the second tool is the forming tool and which is the supporting tool used for forming at least a first feature of the features is performed based on whether the first feature is an internal feature having one or more other features disposed laterally outside of the first feature and based on which of the sides of the sheet that the first feature protrudes from.

In another aspect, the first tool and the second tool are laterally moved along a single toolpath on the sheet in order to form the three-dimensional component from the sheet.

In another aspect, the toolpath is a helical toolpath.

In another aspect, the method also includes generating the toolpath such that the first and second tools avoid further deformation of a previously formed protruding feature of the three-dimensional component when later deforming the sheet to form a subsequently formed protruding feature.

In another aspect, laterally moving the first and second tools includes moving the first and second tools to move outward from a center location of the sheet.

In another aspect, the three-dimensional component that is formed from the sheet includes protruding features that extend from both sides of the sheet.

In one embodiment, a system (e.g., a control system or control unit for a forming system) includes an input module, an equalization module, a sorting module, a point generation module, and a path writing module. The input module is configured to obtain a three-dimensional model of a component to be formed from a deformable sheet by first and second tools that engage corresponding first and second opposite sides of the sheet and that move relative to the sheet to deform the sheet. The three-dimensional model includes plural three-dimensional features that protrude from at least one of the first side or second side of the sheet. The equalization module is configured to an incremental depth at which the at least one of the first and second tools move toward or away from the sheet to form the features in the sheet. The incremental depth is based on a number of curves formed by intersections of the model with a set of planes oriented parallel to the sheet. The sorting module is configured to associate at least a first set of the curves formed by the intersections of the model with the planes with a first feature of the features in the model and a second set of the curves formed by the intersections of the model with the planes with a different, second feature of the features in the model. The point generation module is configured to determine one or more toolpaths that the first and second tools follow in order to deform the sheet into the component. The point generation module also is configured to determine segments of the model that are disposed between neighboring planes in the set of planes and to determine one or more helical curves extending along the segments from an internal area of the sheet toward outer boundaries of the sheet. The path writing module is configured to identify contact points along the one or more toolpaths and directions in which the first and second tools are to move along the one or more toolpaths. The contact points are locations where the first and second tools are to engage and deform the sheet to form the component from the sheet based on the model. The path writing module determines the contact points and the directions such that the first and second tools move along the one or more toolpaths in an in-to-out direction laterally along the sheet.

In another aspect, the equalization module is configured to change the incremental depth such that, for each pair of neighboring planes in the set of planes, a number of the curves formed by a first intersection of a first plane with the model is equal to a number of the curves formed by a second intersection of a second plane with the model. The first and second planes are separated from each other by the incremental depth.

In another aspect, the sorting module is configured to associate the curves with the first or second features based on at least one of areas encompassed by the curves or centroidal distances between the curves in different planes.

In another aspect, the point generation module is configured to determine the one or more toolpaths by intersecting one or more helicoids with the segments of the model.

In another aspect, for each of the contact points used to form each of the features, the path writing module is configured to determine which of the first or second tools is a supporting tool that supports the sheet and the other of the first or second tools is a forming tool that moves relative to the supporting tool to deform the sheet at the corresponding contact point.

In another aspect, the path writing module is configured to switch which of the first or second tools is the forming tool at different ones of the contact points along the same toolpath.

In another aspect, the path writing module is configured to determine which of the first or second tools is the forming tool at the contact points based on a direction in which the sheet is to be deformed at the corresponding contact point and based on whether the feature being formed by deformation at the contact point is an internal or external feature.

In one embodiment, a system (e.g., a forming system) includes first and second tools, one or more moving assemblies, and a control unit. The first tool is configured to be disposed on one side of a deformable sheet. The second tool is configured to be disposed on an opposite side of the sheet. The moving assemblies are configured to move the first tool and the second tool relative to the sheet. The control unit is configured to control movement of the first tool and the second tool by the one or more moving assemblies. The control unit is configured to move the first and second tools in a deformation direction to deform the sheet, then move the first and second tools laterally to a subsequent location while engaging the sheet, then move the first and second tools in the deformation direction or an opposite direction to deform the sheet, and to continue moving the first and second tools to deform the sheet in order to create a three-dimensional component from the sheet.

In another aspect, the control unit is configured to deform the sheet by an equivalent distance that the first and second tools are moved in the deformation direction.

In another aspect, the control unit is configured to laterally move the first and second tools to deformation locations where the first and second tools deform the sheet. The control unit also is configured to laterally move the first and second tools between the deformation locations in an outward direction toward an outer edge of the sheet from a location that is closer to a center of the sheet.

In another aspect, the control unit is configured to move the first and second tools to deform the sheet such that the first and second tools remain at a constant vertical location relative to the sheet.

In another aspect, the first and second tools are non-rotating tools.

In another aspect, the control unit is configured to control movement of the first tool and the second tool by displacement control.

In another aspect, the control unit is configured to move the first and second tools to maintain contact with the sheet at all times during formation of the component.

In another embodiment, a method (e.g., a forming method) includes engaging a first tool with one side of a deformable sheet, engaging a second tool with an opposite side of the sheet, moving the first and second tools in a deformation direction to deform the sheet, laterally moving the first and second tools laterally to a subsequent location while engaging the sheet, deforming the sheet by moving the first and second tools in the deformation direction or an opposite direction, and moving the first and second tools to deform the sheet in order to create a three-dimensional component from the sheet.

In another aspect, deforming the sheet includes deforming the sheet by an equivalent distance that the first and second tools are moved in the deformation direction.

In another aspect, laterally moving the first and second tools includes moving the first and second tools a location that is closer to a center of the sheet than an outer edge of the sheet toward the outer edge.

In another aspect, the first and second tools are moved to deform the sheet such that the first and second tools remain at a constant vertical location relative to the sheet.

In another aspect, a point of contact corresponding to a beginning edge of a bend in the sheet does not lie along a line connecting centers of hemispheres corresponding to the first and second tools.

In another embodiment, another system (e.g., a forming system) includes a first tool, a second tool, one or more moving assemblies, and a control unit. The first tool is configured to be disposed on one side of a deformable sheet. The second tool is configured to be disposed on an opposite side of the sheet. The one or more moving assemblies are configured to move at least one of the first tool and the second tool relative to the sheet. The control unit is configured to control movement of the first tool and the second tool by the one or more moving assemblies. The control unit is configured to move the at least one of the first and second tools in a deformation direction to deform the sheet, then move the at least one of the first and second tools laterally to a subsequent location while engaging the sheet, then move the at least one of the first and second tools in the deformation direction or an opposite direction to deform the sheet, and to continue moving the at least one of the first and second tools to deform the sheet in order to create a three-dimensional component from the sheet.

In another aspect, a point of contact corresponding to a beginning edge of a bend in the sheet does not lie along a line connecting centers of hemispheres corresponding to the first and second tools.

In another embodiment, another system (e.g., a forming system) includes a first tool, a second tool, one or more moving assemblies, and a control unit. The first tool is configured to be disposed on one side of a deformable sheet. The second tool is configured to be disposed on an opposite side of the sheet. The one or more moving assemblies are configured to move the first tool and the second tool relative to the sheet.

The control unit is configured to control movement of the first tool and the second tool by the one or more moving assemblies. The control unit is configured to move the first and second tools in a deformation direction to deform the sheet (where a point of contact corresponding to a beginning edge of a bend in the sheet does not lie along a line connecting centers of hemispheres corresponding to the first and second tools), then move the first and second tools laterally to a subsequent location while engaging the sheet, then move the first and second tools in the deformation direction or an opposite direction to deform the sheet, and to continue moving the first and second tools to deform the sheet in order to create a three-dimensional component from the sheet.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the inventive subject matter without departing from its scope. While relative dimensions described herein are intended to define the parameters of the inventive subject matter, they are by no means limiting and are example embodiments. Many other embodiments will be apparent to one of ordinary skill in the art upon reviewing the above description. The scope of the inventive subject matter should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

The foregoing description of certain embodiments of the present inventive subject matter will be better understood when read in conjunction with the appended drawings. To the extent that the figures illustrate diagrams of the functional blocks of various embodiments, the functional blocks are not necessarily indicative of the division between hardware circuitry. Thus, for example, one or more of the functional blocks (for example, processors or memories) may be implemented in a single piece of hardware (for example, a general purpose signal processor, microcontroller, random access memory, hard disk, and the like). Similarly, the programs may be stand alone programs, may be incorporated as subroutines in an operating system, may be functions in an installed software package, and the like. The various embodiments are not limited to the arrangements and instrumentality shown in the drawings.

The invention claimed is:

1. A system comprising:

a first tool configured to be disposed on a first side of a deformable sheet;

a second tool configured to be disposed on an opposite, second side of the sheet;

one or more moving assemblies configured to move the first tool and the second tool relative to the sheet;

a control unit configured to control movement of the first tool and the second tool by the one or more moving assemblies, wherein the control unit is configured to move at least one of the first tool or the second tool in a first deformation direction to deform the sheet, then move the first and second tools laterally relative to the sheet to a subsequent location while engaging the sheet, then move at least one of the first tool or the second tool in the first deformation direction or an opposite second deformation direction to deform the sheet, and to continue moving the first and second tools to deform the sheet in order to create a three-dimensional component from the sheet;

an input module configured to obtain a three-dimensional model of a component to be formed from a deformable sheet by first and second tools that engage corresponding first and second opposite sides of the sheet and that move relative to the sheet to deform the sheet, the three-dimensional model including plural three-dimensional features that protrude from at least one of the first side or second side of the sheet;

an equalization module configured to an incremental depth at which the at least one of the first and second tools move toward or away from the sheet to form the features in the sheet, the incremental depth based on a number of curves formed by intersections of the model with a set of planes oriented parallel to the sheet;

a sorting module configured to associate at least a first set of the curves formed by the intersections of the model with the planes with a first feature of the features in the model and a second set of the curves formed by the intersections of the model with the planes with a different, second feature of the features in the model;

a point generation module configured to determine one or more toolpaths that the first and second tools follow in order to deform the sheet into the component, the point generation module configured to determine segments of the model that are disposed between neighboring planes in the set of planes and to determine one or more helical curves extending along the segments from an internal area of the sheet toward outer boundaries of the sheet; and a path writing module configured to identify contact points along the one or more toolpaths and directions in which the first and second tools are to move along the one or more toolpaths, the contact points being locations where the first and second tools are to engage and deform the sheet to form the component from the sheet based on the model, wherein the path writing module determines the contact points and the directions such that the first and second tools move along the one or more toolpaths in an in-to-out direction laterally along the sheet.

2. The system of claim 1, wherein one of the first tool or the second tool is a forming tool and the other of the first tool or the second tool is a supporting tool, and the control unit is configured to move the forming tool in the deformation direction relative to the supporting tool to deform the sheet.

3. The system of claim 2, wherein the control unit is configured to switch which of the first or second tools is the forming tool and which is the supporting tool in order to change which direction the sheet is deformed.

4. The system of claim 2, wherein the three-dimensional component includes plural three-dimensional features that protrude from one or more of the sides of the sheet, and the control unit is configured to determine which of the first tool or the second tool is the forming tool and which is the supporting tool for forming at least a first feature of the features based on whether the first feature is an internal feature having one or more other features disposed laterally outside of the first feature and based on which of the sides of the sheet that the first feature protrudes from.

5. The system of claim 1, wherein the control unit is configured to at least one of receive or generate a single toolpath along the sheet for the first and second tools to follow to form the three-dimensional component from the sheet.

6. The system of claim 5, wherein the toolpath is a helical tool path.

7. The system of claim 5, wherein the control unit is configured to generate the toolpath such that the first and second tools avoid further defonnation of a previously formed protruding feature of the three-dimensional component when later deforming the sheet to form a subsequently formed protruding feature.

8. The system of claim 1, wherein the control unit is configured to direct the first and second tools to deform the sheet by causing the first and second tools to laterally move outward relative to the sheet from a center location of the sheet after the at least one of the first tool or the second tool is moved in the first deformation direction.

9. The system of claim 1, wherein the control unit is configured to move the first and second tools to create the three-dimensional component that includes protruding features that extend from both sides of the sheet.

10. A system comprising:

a processor; the processor comprising;

an input module configured to obtain a three-dimensional model of a component to be formed from a deformable sheet by first and second tools that engage corresponding first and second opposite sides of the sheet and that move relative to the sheet to deform the sheet, the three-dimensional model including plural three-dimensional features that protrude from at least one of the first side or second side of the sheet;

an equalization module configured to an incremental depth at which the at least one of the first and second tools move toward or away from the sheet to form the features in the sheet, the incremental depth based on a number of curves formed by intersections of the model with a set of planes oriented parallel to the sheet;

a sorting module configured to associate at least a first set of the curves formed by the intersections of the model with the planes with a first feature of the features in the model and a second set of the curves formed by the intersections of the model with the planes with a different, second feature of the features in the model;

a point generation module configured to determine one or more toolpaths that the first and second tools follow in order to deform the sheet into the component, the point generation module configured to determine segments of the model that are disposed between neighboring planes in the set of planes and to determine one or more helical curves extending along the segments from an internal area of the sheet toward outer boundaries of the sheet; and a path writing module configured to identify contact points along the one or more toolpaths and directions in which the first and second tools are to move along the one or more toolpaths, the contact points being locations where the first and second tools are to engage and deform the sheet to form the component from the sheet based on the model, wherein the path writing module determines the contact points and the directions such that the first and second tools move along the one or more toolpaths in an in-to-out direction laterally along the sheet; wherein the tools of the system engage the sheet to deform the sheet into the component defined by the model.

11. The system of claim 10, wherein the equalization module is configured to change the incremental depth such that, for each pair of neighboring planes in the set of planes, a number of the curves formed by a first intersection of a first plane with the model is equal to a number of the curves formed by a second intersection of a second plane with the model, the first and second planes being separated from each other by the incremental depth.

12. The system of claim 10, wherein the sorting module is configured to associate the curves with the first or second features based on at least one of areas encompassed by the curves or centroidal distances between the curves in different planes.

13. The system of claim 10, wherein the point generation module is configured to determine the one or more toolpaths by intersecting one or more helicoids with the segments of the model.

14. The system of claim 10, wherein, for each of the contact points used to form each of the features, the path writing module is configured to determine which of the first or second tools is a supporting tool that supports the sheet and the other of the first or second tools is a forming tool that moves relative to the supporting tool to deform the sheet at the corresponding contact point.

15. The system of claim 14, wherein the path writing module is configured to switch which of the first or second tools is the forming tool at different ones of the contact points along the same toolpath.

16. The system of claim 14, wherein the path writing module is configured to determine which of the first or second tools is the forming tool at the contact points based on a direction in which the sheet is to be deformed at the corresponding contact point and based on whether the feature being formed by deformation at the contact point is an internal or external feature.

17. A method for obtaining a three-dimensional model of a component formed from a deformable sheet having first and second opposite sides and including plural three-dimensional features that protrude from at least one of the first side or second side of the sheet, the method comprising:

a processor performing:

engaging the corresponding first and second opposite sides of the deformable sheet with first and second tools and moving said tools relative to the sheet to deform the sheet; wherein the first and second tools are engage the sheet to deform the sheet into the component defined by the model;

moving at least one of the first and second tools toward or away from the deformable sheet to an incremental depth to form the features in the sheet, the incremental depth being based on a number of curves formed by intersections of the model with a set of planes oriented parallel to the sheet;

associating at least a first set of the curves formed by the intersections of the model with the planes with a first feature of the features in the model and a second set of the curves formed by the intersections of the model with the planes with a different, second feature of the features in the model;

determining one or more toolpaths that the first and second tools follow in order to deform the sheet into the component by determining segments of the model that are disposed between neighboring planes in the set of planes and determining one or more helical curves extending along the segments from an internal area of the sheet toward outer boundaries of the sheet; and identifying contact points along the one or more toolpaths and directions in which the first and second tools are to move along the one or more toolpaths, the contact points being locations where the first and second tools are to engage and deform the sheet to form the component from the sheet based on the model, wherein the contact points and the directions are determined such that the first and second tools move along the one or more toolpaths in an in-to-out direction laterally along the sheet.

18. The method of claim 17, wherein the first tool or the second tool that moves move in a first deformation direction or a second deformation direction such that the first tool is a forming tool and the second tool is a supporting tool, further wherein the forming tool meres moving relative to the supporting tool.

19. The method of claim 18, further comprising switching which of the first or second tools is the forming tool and which is the supporting tool in order to change which direction the sheet is deformed.

20. The method of claim 18, further comprising switching which of the first tool or the second tool is the forming tool and which is the supporting tool used for forming at least a first feature of the features is performed based on whether the first feature is an internal feature having one or more other features disposed laterally outside of the first feature and based on which of the sides of the sheet that the first feature protrudes from.

21. The method of claim 17, wherein the first tool and the second tool are laterally moved along a single toolpath on the sheet in order to form the three-dimensional component from the sheet.

22. The method of claim 21, wherein the toolpath is a helical toolpath.

23. The method of claim 21, further comprising generating the toolpath such that the first and second tools avoid further deformation of a previously formed protruding feature of the three-dimensional component when later deforming the sheet to form a subsequently formed protruding feature.

24. The method of claim 17, wherein laterally moving the first and second tools includes moving the first and second tools to move outward from a center location of the sheet.

25. The method of claim 17, wherein the three-dimensional component that is formed from the sheet includes protruding features that extend from both sides of the sheet.

* * * * *